US010687602B2

(12) United States Patent
Thulin et al.

(10) Patent No.: US 10,687,602 B2
(45) Date of Patent: Jun. 23, 2020

(54) PACKAGE FOR CONSUMER CARE PRODUCTS

(71) Applicant: The Procter & Gamble Company, Cincinnati, OH (US)

(72) Inventors: Nathaniel David Thulin, Hebron, KY (US); Justin Alan Ellsworth, Liberty Township, OH (US); Nathan Daniel Grubbs, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/162,531

(22) Filed: Oct. 17, 2018

(65) Prior Publication Data

US 2019/0110575 A1 Apr. 18, 2019

(30) Foreign Application Priority Data

Oct. 18, 2017 (EP) ..... 17197049

(51) Int. Cl.

| | |
|---|---|
| ***B43K 21/08*** | (2006.01) |
| ***A45D 40/04*** | (2006.01) |
| ***B65D 83/00*** | (2006.01) |
| *A45D 40/00* | (2006.01) |

(52) U.S. Cl.

CPC ..... *A45D 40/04* (2013.01); *B65D 83/0011* (2013.01); *A45D 2040/0012* (2013.01); *A45D 2200/05* (2013.01)

(58) Field of Classification Search

CPC ..... A45D 40/02; A45D 40/04; A45D 40/12; B65D 83/0011; B65D 83/0033

USPC ..... 401/68, 75

See application file for complete search history.

(56) References Cited

U.S. PATENT DOCUMENTS

| | | | | |
|---|---|---|---|---|
| 7,389,894 | B2 | 6/2008 | Danne et al. | |
| 8,096,724 | B2 * | 1/2012 | Bolander | A45D 40/04 206/229 |
| 8,388,249 | B2 * | 3/2013 | Groh | B65D 83/0011 401/175 |
| 9,433,275 | B2 | 9/2016 | Crawford | |
| 9,565,919 | B2 | 2/2017 | Walling | |
| 9,709,619 | B2 | 7/2017 | Iriguchi | |
| 9,795,206 | B2 | 10/2017 | Ellsworth | |
| 9,820,551 | B2 * | 11/2017 | Ellsworth | A45D 40/12 |
| 9,867,445 | B2 | 1/2018 | Ellsworth | |
| 10,315,832 | B2 * | 6/2019 | Ellsworth | A45D 34/04 |
| 10,517,373 | B2 | 12/2019 | Ellsworth | |
| 2004/0206783 | A1 | 10/2004 | Danne | |
| 2016/0029771 | A1 | 2/2016 | Walling | |
| 2016/0174686 | A1 | 6/2016 | Ellsworth | |
| 2018/0086541 | A1 | 3/2018 | Ellsworth | |

OTHER PUBLICATIONS

PCT International Search Report and Written Opinion, dated Jan. 25, 2019 (13 pages).

International Search Report; International Application No. PCT/US2018/055799; dated Jan. 25, 2019; 14 pages.

* cited by examiner

*Primary Examiner* — Jennifer C Chiang

(74) *Attorney, Agent, or Firm* — Kathleen Y. Carter

(57) ABSTRACT

A dispensing package comprising one or more jackets, a screw assembly, and a movable elevator platform; the screw assembly comprising a spindle comprising two external thread portions, which allows for a quick first turn.

15 Claims, 25 Drawing Sheets

PACKAGE FOR CONSUMER CARE PRODUCTS

CROSS REFERENCE TO RELATED APPLICATION

This application claims the benefit of EP filing 17197049.4, filed Oct. 18, 2017, the substance of which is incorporated herein by reference.

FIELD OF THE INVENTION

The present invention relates to packages for consumer care products. The packages are particularly suited for antiperspirant and/or deodorant products, but can equally be employed for other types of consumer care products.

The dispensing package for consumer care products includes a longitudinal axis; one or more jackets, wherein the one or more jackets comprise a first end, a second end opposite the first end; a screw assembly; and a movable elevator platform.

BACKGROUND OF THE INVENTION

The consumer products industry is continually releasing a variety of new and improved consumer products. As such, the consumer products industry is continually providing to the consumers a wide variety of product packages to dispense and deliver this ever-growing variety of products.

The antiperspirant and/or deodorant product is normally introduced into the dispensing package itself, the movable elevator platform being in its lowermost position. When the dispensing package is normally filled from above so an empty space namely a dead space is unavoidably formed in the upper part of the dispensing package during the filling process. This empty space is typically a function of the height of the dispensing package and optionally by the curvature of the applicator. In addition, the empty space can also be caused by the product, i.e. the volume of product can decrease after filling, for example through air bubbles which escape after the filling process.

Because of the empty space between the outlet opening and the product, the operating button has to be repeatedly operated several times before the dispensing package is used for the first time in order to deliver to the consumer the first dose of the dispensed product.

There is still a need for improved consumer product packages that can serve as dispensing and delivery packages for multiple products, in order to get more easily and quicker the first dose of the dispensed product without comprising the precise dosing delivering of the dispensed product.

SUMMARY OF THE INVENTION

A dispensing package 100 is provided and comprises:

a longitudinal axis L;

one or more jackets (200, 110), wherein the one or more jackets (200, 110) comprise a first end 260, a second end 250 opposite the first end 260;

a screw assembly 330; and a movable elevator platform 320; wherein the screw assembly 330 comprises a screw base disposed adjacent to the first end 260 and rotatably associated with the one or more jackets (200, 110); a spindle 332 that supports external threads 333, wherein the spindle 332 extends from the screw base 331 through the first end 260 into the one or more jackets (200, 110) coaxial to the longitudinal axis L of the dispensing package 100.

The spindle 332 comprises a first external thread portion 335 having a first pitch P1; and a second external thread portion 337 having a second pitch P2; wherein the second pitch P2 is larger than the first pitch P1.

The movable elevator platform 320 is movably engaged with the spindle 332 of the screw assembly 330 and comprises a coupling sleeve 325 having an inner surface 550, wherein the coupling sleeve 325 is coaxial to the longitudinal axis L of the dispensing package 100, wherein the coupling sleeve 325 supporting internal threads has a first internal thread portion 530 having a first pitch p1; a second internal thread portion 540 having a second pitch p2.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the second internal thread portion 540 of the movable elevator platform 320 along the inner surface 550 of the movable elevator platform 320 such that the second pitch p2 of the second internal thread portion 540 is comprised between the first pitch P1 of the first external thread portion 335 and the second pitch P2 of the second external thread portion 337.

BRIEF DESCRIPTION OF THE DRAWINGS

While the specification concludes with claims particularly pointing out and distinctly claiming the present invention, it is believed that the same will be better understood from the following description read in conjunction with the accompanying drawings in which:

Figure 1:
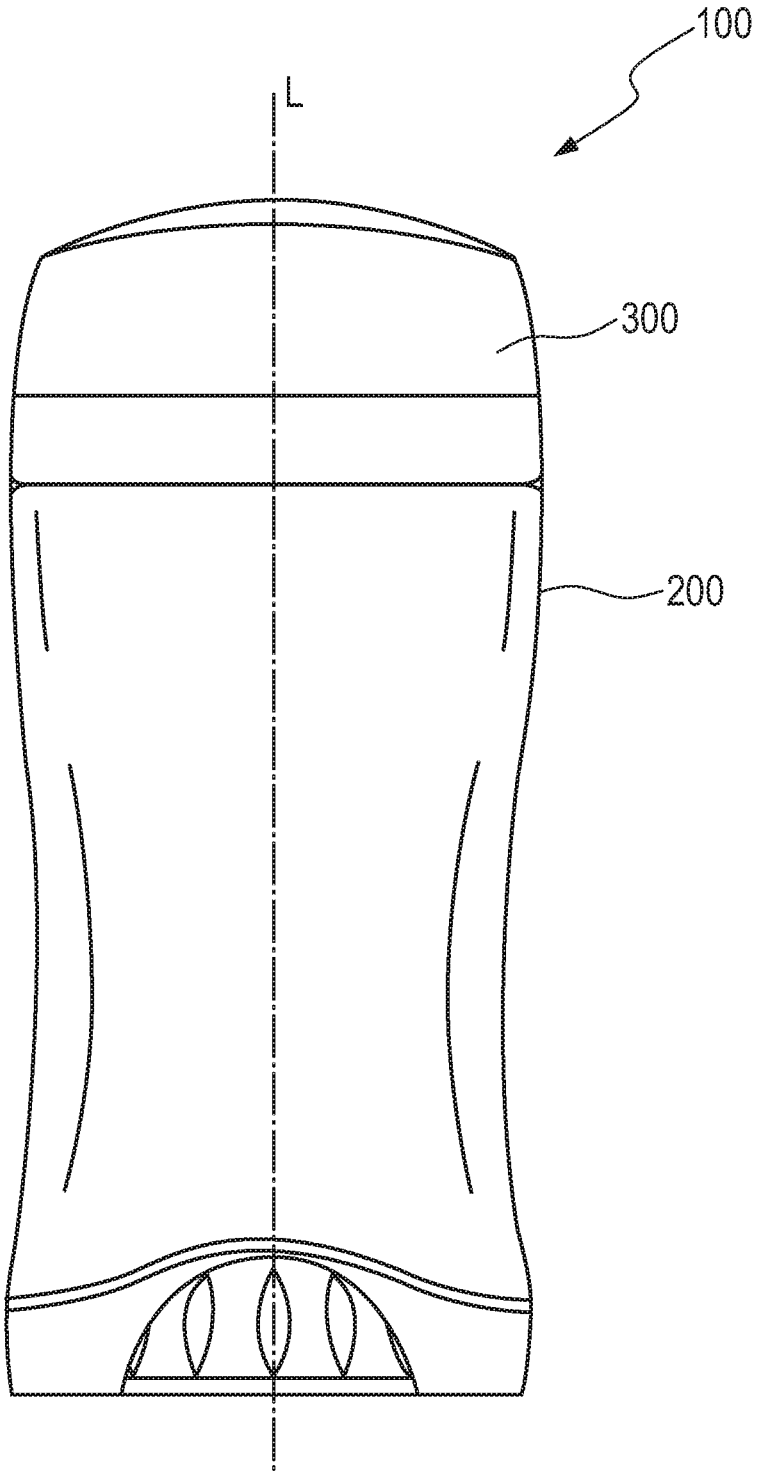
FIG. 1 is a front view of a dispensing package for consumer care products shown and described herein.

It should be noted that these figures are diagrammatic and not drawn to scale. Relative dimensions and proportions of parts of these figures have been shown exaggerated or reduced in size, for the sake of clarity and convenience in the drawings.

DETAILED DESCRIPTION OF THE INVENTION

Definitions and General

In this document, including in all embodiments of all aspects of the present invention, the following definitions apply unless specifically stated otherwise.

"Comprise", "comprising", and "comprises" as used herein are open ended terms, each specifying the presence of what follows, e.g., a component, but not precluding the presence of other features, e.g., elements, steps or components known in the art, or disclosed herein.

"Consumer care product", as used herein, also referred to as the "product", refers to any consumer care product including but not limited to beauty care products, personal care products, household care products, health care products, pet care products and the like.

"Cross-threading" as used herein means screwing together two pieces which have misaligned threads and/or one piece may not have any threads at all but one or more features selected from the group consisting of a smooth surface, vertical ribs, horizontal ribs, similar features and combinations thereof; through which a mating set of threads can "cut" through to enable the intended screw pitch to function.

"Lead" as used herein is the distance along the spindle axis for the screw assembly or along the coupling sleeve axis (both axis being parallel to the longitudinal axis of the dispensing package), that is covered by one complete revolution of the screw.

"Pitch" as used herein is the distance from the crest of one thread to the next crest.

"Major diameter" as used herein is for threads, the larger of two extreme diameters delimiting the height of the thread profile, as a cross-sectional view if taken in a plane containing the axis of the threads. For a spindle of a screw assembly, the major diameter is the outside diameter. In other words, the major diameter for the threads of the spindle is the diameter across the crests of the threads. The major diameter for the internal threads of the coupling sleeve is the diameter across the roots of the internal threads.

"Minor diameter" as used herein is for threads, is the lower extreme diameter of the threads. In other words, the minor diameter for the threads of the spindle is the diameter across the roots of the threads. The major diameter for the internal threads of the coupling sleeve is the diameter across the crests of the internal threads.

"Third non-threaded portion of the spindle" as used herein means that the spindle comprises a third portion free of threads. The third non-threaded portion of the spindle may preferably comprise a cylindrical shape.

"Pitch diameter" as used herein is for internal or external threads, the diameter of a cylindrical surface, axially concentric to the thread, which intersects the thread flanks at equidistant points, when viewed in a cross-sectional plane containing the axis of the thread, the distance between these points being exactly one half the pitch distance.

"Torque" as used herein is a rotational force.

Herein, the axis of the threads of the spindle and the axis of the internal threads of the coupling sleeve are coaxial with the longitudinal axis of the dispensing package.

General Description of the Dispensing Package

A dispensing package 100 is provided and comprises a longitudinal axis L. FIG. 1 is a front elevation of a dispensing package for consumer care products as fully assembled according to the invention. The dispensing package 100 comprises an outer cap 300 and a jacket 200. The dispensing package 100 comprises one or more jackets (200, 110), wherein the one or more jackets (200, 110) comprises a first end 260, and a second end 250 opposite to the first end 260.

Figure 2A:
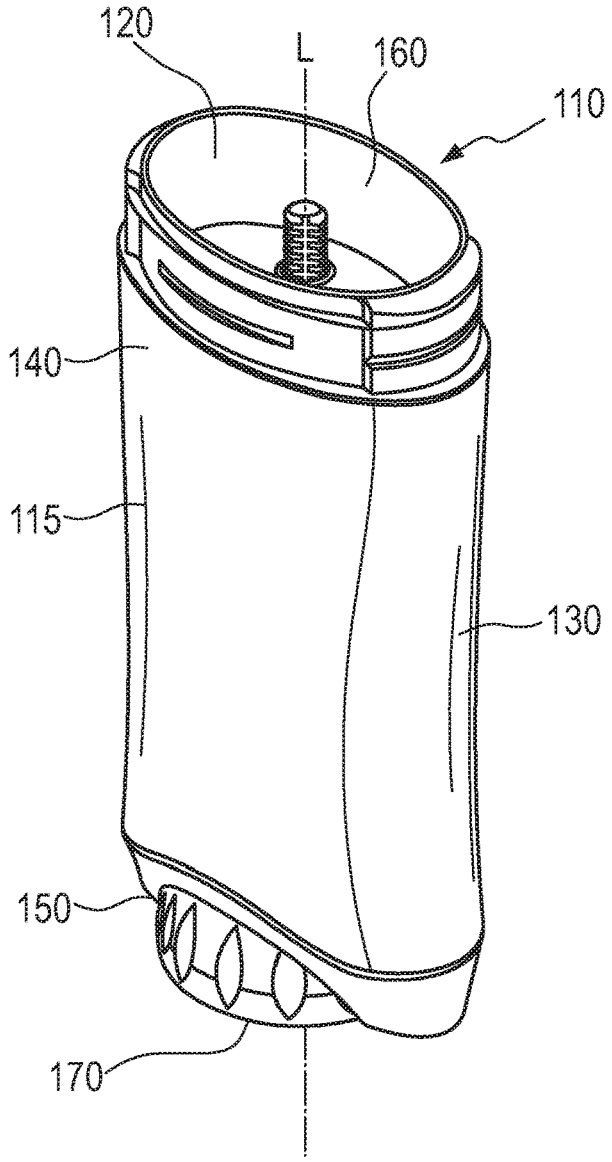
FIG. 2A is a front perspective view of the dispensing package having one single jacket, being a chamber product.

The dispensing package 100 may comprise one single jacket, wherein the one jacket is a product chamber 110, as shown in FIG. 2A. The product chamber 110 may at least partially surround and support a consumer care product. The product chamber 110 may comprise a side wall 115 having an inner surface 120, an outer surface 130, an upper dispensing end 140, a lower end 150, a top opening 160, wherein the consumer care product can move up and outward, and a bottom opening 170.

The one single jacket 110 may comprise an internal space which is defined by the internal surface 120 of the side wall 115, the upper dispensing end 140 and the lower end 150.

Figure 2B:
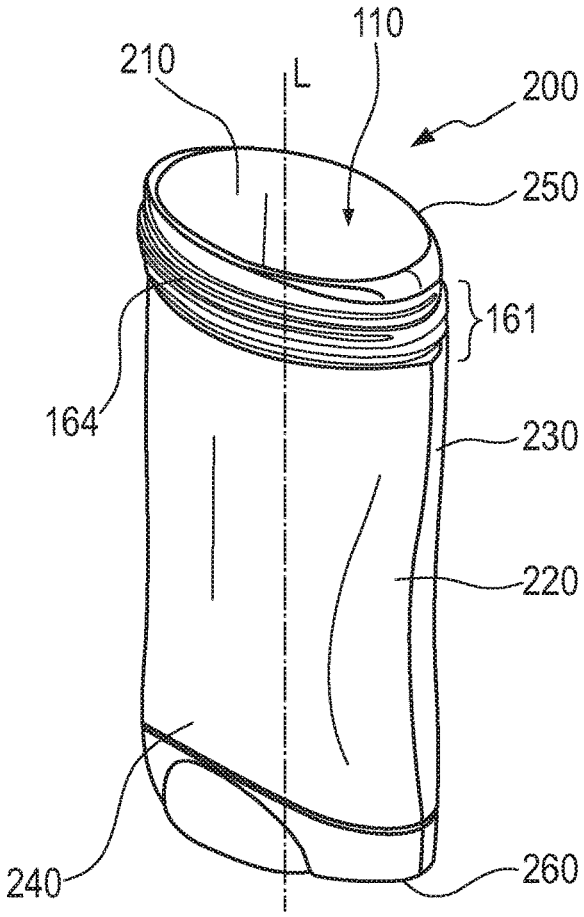
FIG. 2B is a front perspective view of another dispensing package having an outer jacket and a product chamber.

Alternatively, the one or more jackets may comprise an outer jacket 200 and a product chamber 110, as shown in FIG. 2B. The outer jacket may comprise a top opening 250 and a bottom opening 260. The product chamber 110 may be disposed within the outer jacket 200 and may comprise a top opening 160 and a bottom opening 170.

Figure 3A:
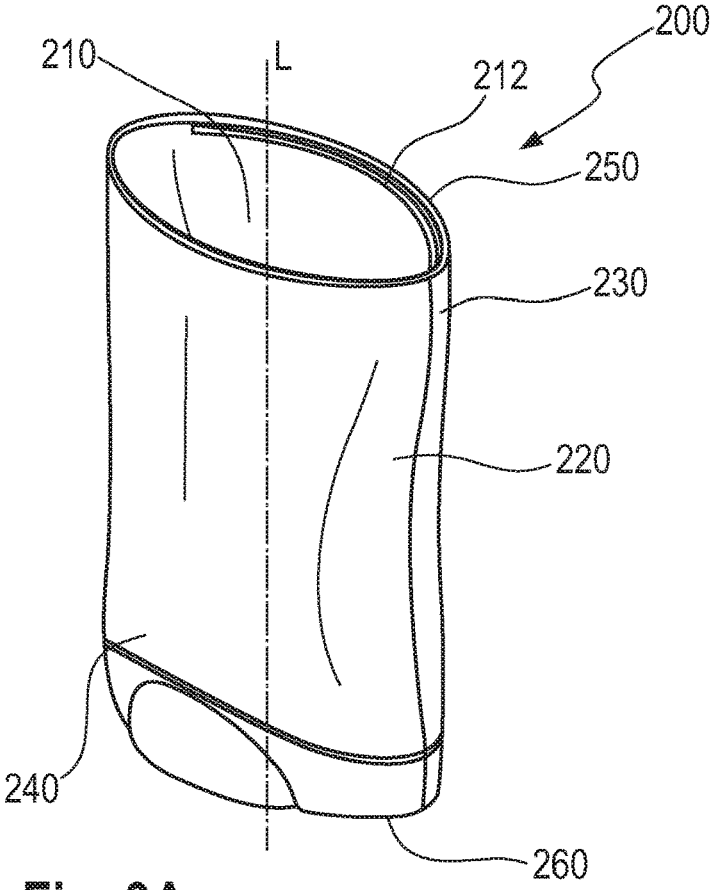
FIG. 3A is a front perspective view of the outer jacket of another dispensing package of FIG. 2B.

As shown in FIG. 3A, the dispensing package 100 may comprise an outer jacket 200 further comprising at least one wall having an inside surface 210 that at least partially surrounds and further supports the product chamber 110. The outer jacket 200 may further comprise an outside surface 220, an upper end 230, a lower end 240, a top opening 250, a bottom opening 260. The top opening 250 allows the consumer care product being dispensed via the product chamber 110 outside the outer jacket 200.

The inside surface 210 of the outer jacket 200 may comprise at least one rib 212 as shown in FIG. 3A, or any other conventional means of engagement with the product chamber 110. For example, in FIG. 3A, the rib 212 on the inner surface of the outer jacket 200 can engage with a groove 164 in a top ridged opening 161 (FIG. 3B) of the product chamber 110 in order to keep the product chamber 110 engaged with the outer jacket 200.

Figure 3B:
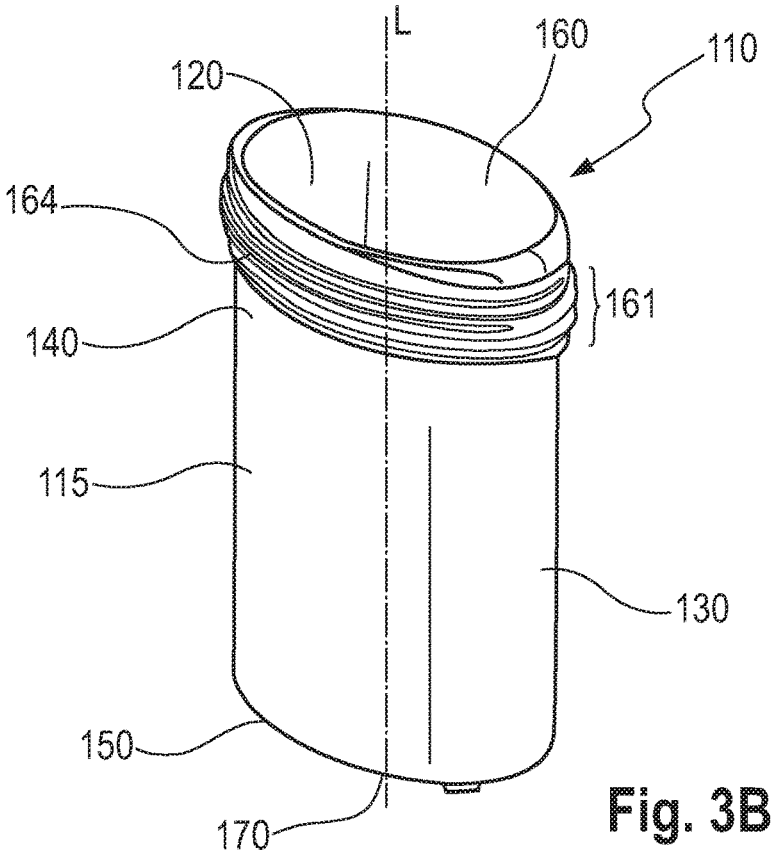
FIG. 3B is a front perspective view of the product chamber of another dispensing package of FIG. 2B.

As shown in FIG. 3B, the dispensing package 100 may comprise a product chamber 110 that at least partially surrounds and supports a consumer care product. The product chamber 110 may comprise a side wall 115 having an inner surface 120, an outer surface 130, an upper dispensing end 140, a lower end 150, a top opening 160, wherein the consumer care product can move up and outward, a top ridged opening 161 comprising a plurality of grooves 164, and a bottom opening 170.

The chamber 110 may comprise an internal space which is defined by the internal surface 120 of the side wall 115, the upper dispensing end 140 and the lower end 150.

The consumer care product may be in the form of a solid, a semi-solid, liquid, gel, mousse or the like. The consumer care product may be held within the surrounding walls, particularly the inner surface 120 of the product chamber 110. The consumer care product may be dispensed from the top opening 160 and the top ridged opening 161, both located at the dispensing end 140 of the product chamber 110.

Figure 4:
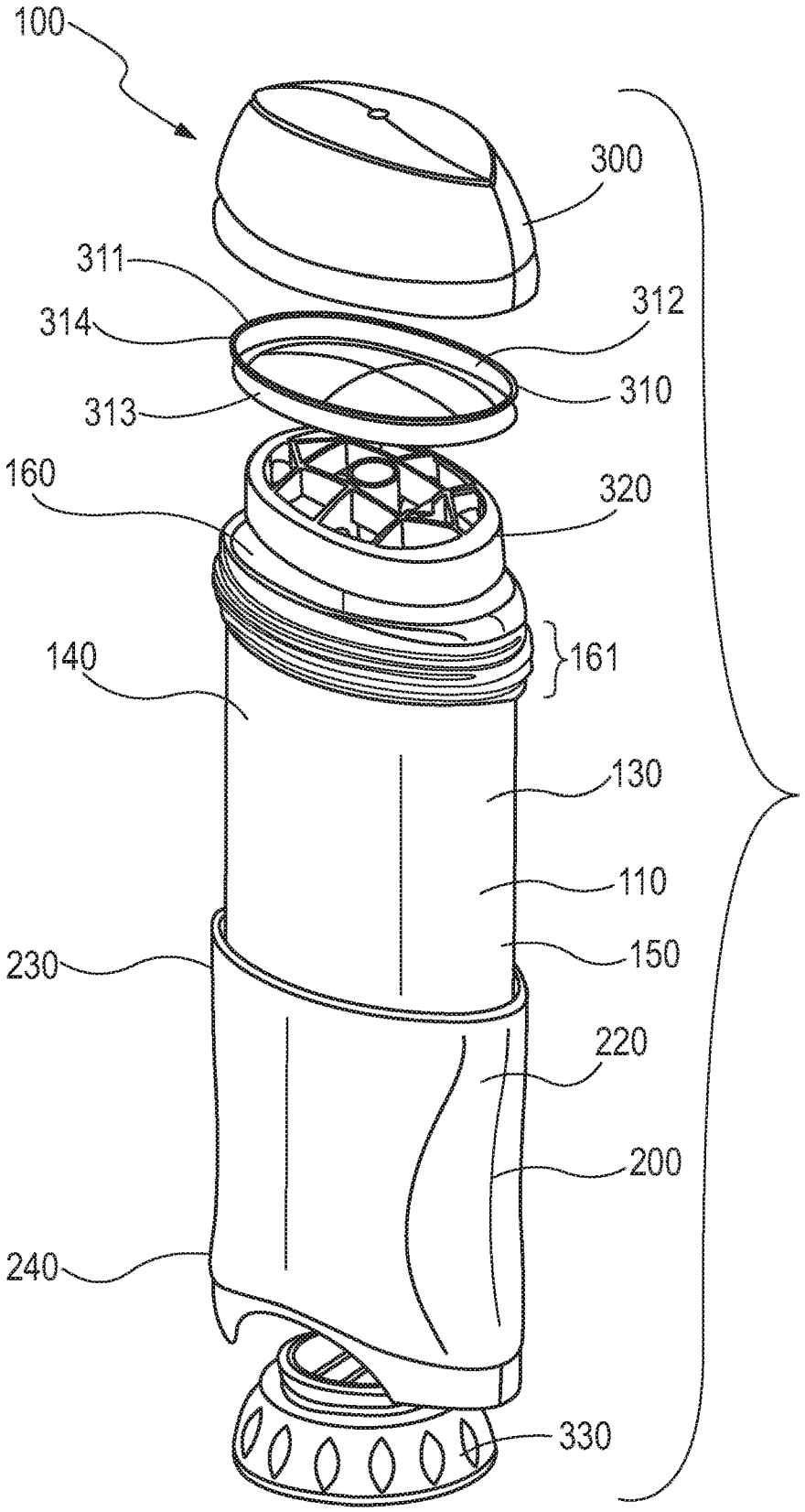
FIG. 4 is an exploded perspective view of FIG. 1 of a dispensing package for consumer care products shown and described herein, illustrating some of the individual components and having a form suitable for bottom filling.

FIG. 4 is an exploded perspective view of FIG. 1 of a dispensing package 100 for consumer care products. In that case, the dispensing package 100 may comprise an outer jacket 200, a product chamber 110 and other individual components such as a screw assembly 330, a movable elevator platform 320, a seal component 310 (or a perforated dome cover 370 instead), and an outer cap 300.

Figure 5:
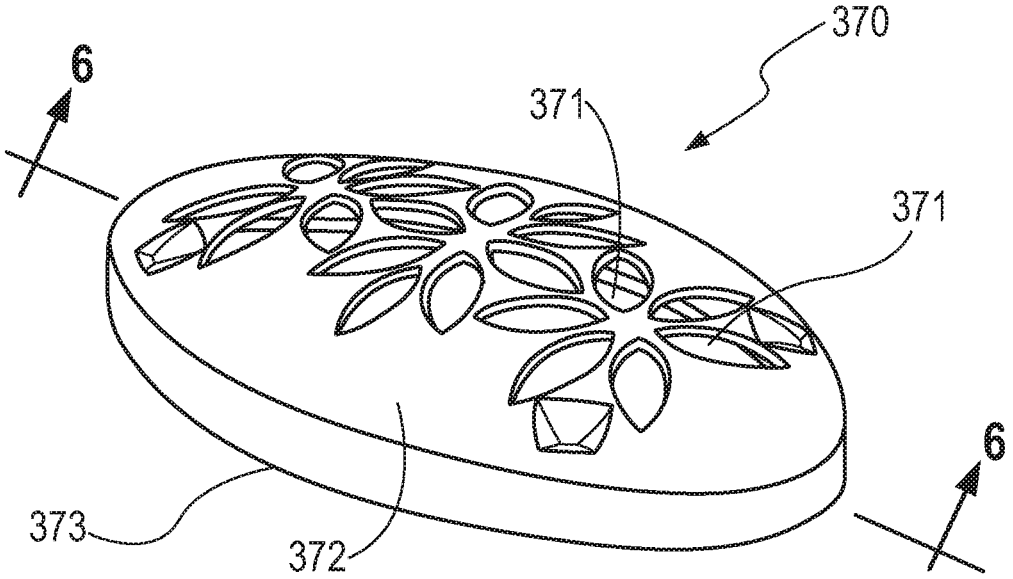
FIG. 5 is a front perspective view of a perforated dome cover of the dispensing package as shown and described herein.
Figure 6:
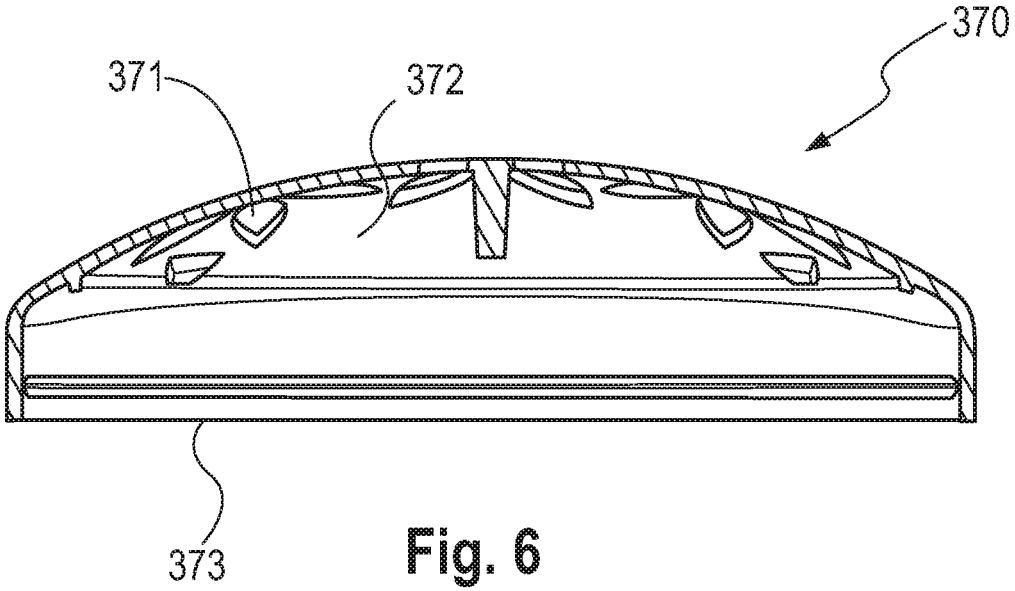
FIG. 6 is a cross-sectional front view of the perforated dome cover taken along the major axis of 6-6 of FIG. 5.

The top opening 160 of the product chamber 110 may optionally comprise an upwardly facing perforated dome cover 370, as shown for instance in FIGS. 5 and 6, which may be integrally formed with the product chamber 110 or be a separate member that is formed separately and then attached to the product chamber 110. The perforated dome cover 370 may be generally useful for compositions with rheology, hardness, and/or melting profiles that are considered gels or semi-solids. The perforated dome cover 370 may extend outwardly from and completely surround the periphery of the top opening 160 and/or the top ridged opening 161 of the product chamber 110.

FIG. 6 is a cross-sectional front view of an example of the perforated dome cover 370 taken along a major axis of 6-6 of FIG. 5.

The perforated dome cover 370 may be a convex surface, may have a rigid surface, having a plurality of apertures 371 extending through the thickness of the perforated dome cover, and through which consumer care product is extruded and flows to the intended site of application on the skin. The perforated dome cover 370 thus may have a convex configuration that extends away or protrudes from the product chamber 110.

In an alternative to the perforated dome cover 370, the top opening 160 may comprise a seal component 310 as shown in FIG. 4. The seal component 310 may be generally a separate member that is attached to the product chamber 110. The seal component 310 may be generally useful for consumer care products with rheologies that are considered to be solids whereby the consumer removes the seal component prior to first use of the product. The seal component 310 thus can function to protect the solid product from degradation or damage during manufacture and storage of the dispensing package 100. The seal component 310 can also serve as a seal to prevent leakage when the dispensing package 100 is filled from the bottom with a molten liquid composition. This can allow the molten liquid composition forming for example into a dome-like shape as it is cooled.

Benefit of the Present Invention

In the dispensing package 100, the movable elevator platform 320 is located in the product chamber 110 at the proximity of the lower end 150, i.e. the lowermost position. The dispensing package 100 can be filled from the top opening 160 of the product chamber 110, especially when the consumer care product is liquid such as a liquid cream. However, during the filing process, an empty space can be formed at the proximity of the top opening 160 of the product chamber 110. The formation of the empty space can be due to the height, and the shape of the dispensing package 100. The empty space can result also from the product in which air bubbles have been generated during the filing process. At the end, because of the empty space between the consumer care product and the top opening 160 of the product chamber 110, for instance between the consumer care product and the dome cover 370, the consumer needs to turn several times a screw base 331 of the screw assembly 330 to get the first dose of the consumer care product out of the product chamber through for instance, the apertures 371 of the dome cover 370.

It has been found that the actuation of the dispensing package 100 for the first time can be simplified for the consumer by providing a movable elevator platform 320 having internal threads that can cross-thread and/or match the external threads of a spindle 332 of the screw assembly 330. With the different aspects as described hereinafter, the movable elevator platform 320 can be displaced upwards in the product chamber 110 in order to dispense the first dose of the consumer care product to the consumer. Although having new features enabling the faster movement of the platform 320 upwards, the dispensing package can still allow the consumer dosing with accuracy the consumer care product he needs.

The dispensing package 100 comprises a screw assembly 330. The screw assembly 330 comprises a screw base 331 disposed adjacent to the first end 260 of the one or more jackets (200, 110), preferably the bottom opening 260 of the outer jacket or the bottom opening 170 of the product chamber 110. The screw assembly 330 is rotatably associated with the one or more jackets (200, 110). The screw assembly 330 includes a spindle 332 that supports external threads 333. The external threads may be typically helical. Other forms of threads may be selected from the group consisting of a trapezoidal thread, a saw-tooth thread, a metric isothread, a Withworth thread, a rounded thread, and combinations thereof. The external threads 333 of the spindle 332 may be continuous or interrupted.

The spindle 332 extends from the screw base 331 through the first end 260 of the one or more jackets (200, 110), into the one or more jackets (200, 110) coaxial to the longitudinal axis L of the dispensing package 100. Hence, the spindle 332 may be attached to the screw base 331. Alternatively, the spindle 332 may form with the screw base 331 one single piece.

The spindle 332 comprises a first external thread portion 335 having a first pitch P1; and a second external thread portion 337 having a second pitch P2. The second pitch P2 is larger than the first pitch P1. The second external thread portion 337 may be preferably located at the proximity of the screw base 331 of the screw assembly 330.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The dispensing package 100 comprises a movable elevator platform 320 which is movably engaged with the spindle 332 of the screw assembly 330. In other words, the movable elevator platform is designed for linear displacement along the spindle 332 by rotation of the spindle 332 in the internal space of the chamber 110 thereof. The movable elevator platform 320 comprises a coupling sleeve 325 having an inner surface 550. The coupling sleeve 325 may be preferably a central opening of the movable elevator platform 320 defining the inner surface 550. The coupling sleeve 325 is coaxial to the longitudinal axis L of the dispensing package 100. The coupling sleeve 325 supports internal threads having a first internal thread portion 530 having a first pitch p1 and a second internal thread portion 540 having a second pitch p2. The internal threads of the coupling sleeve 325 may be continuous or interrupted.

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.025 inch to 0.750 inch (from 0.635 mm to 19.05 mm), preferably from 0.050 inch to 0.600 inch (from 1.27 mm to 15.24 mm), more preferably from 0.075 inch to 0.500 inch (from 1.90 mm to 12.7 mm).

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the second internal thread portion 540 of the movable elevator platform 320 along the inner surface 550 of the movable elevator platform 320 such that the second pitch p2 of the second internal thread portion 540 is comprised between the first pitch P1 of the first external thread portion 335 and the second pitch P2 of the second external thread portion 337.

The movable elevator platform 320 comprises internal threads having first and second internal thread portions 530, 540. The internal threads of the first internal thread portion 530 have the same pitch as the one of the external threads of the first external thread portion 335 of the spindle 332. Hence, the spindle 332 and the movable elevator platform 332 are matching together when the first external thread portion 335 of the screw assembly 330 is engaged with the first internal thread portion 530 of the movable elevator platform 320.

The internal threads of the second internal thread portion 540 have a pitch that can vary from the first pitch P1 of the first external thread portion 335 to the second pitch P2 of the second external thread portion 337.

The second external thread portion 337 of the screw assembly 330 may preferably engage with the second internal thread portion 540 of the movable elevator platform 320 along the inner surface 550 of the movable elevator platform 320 such that the second pitch p2 of the second internal thread portion 540 and the first pitch P1 of the first external thread portion 335 are the same.

Hence, in that case, the internal threads of the coupling sleeve 325 may have preferably the same pitch which is the first pitch P1 of the first external thread portion 335 of the spindle 332.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The first pitch p1 as the second pitch p2 may therefore range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

Figure 7:
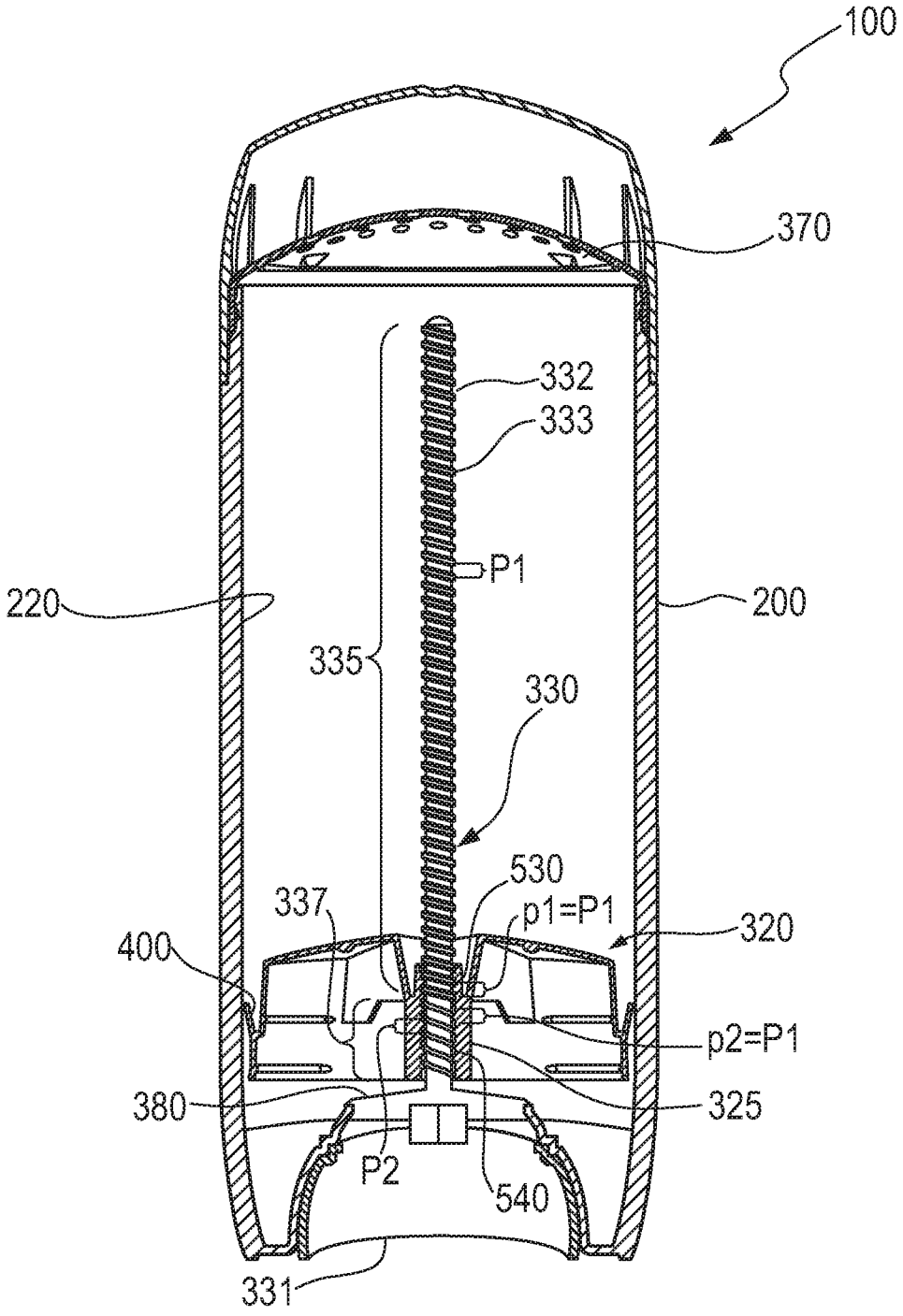
FIG. 7 is a cross sectional view of a dispensing package according to one or more aspects.
Figure 8:
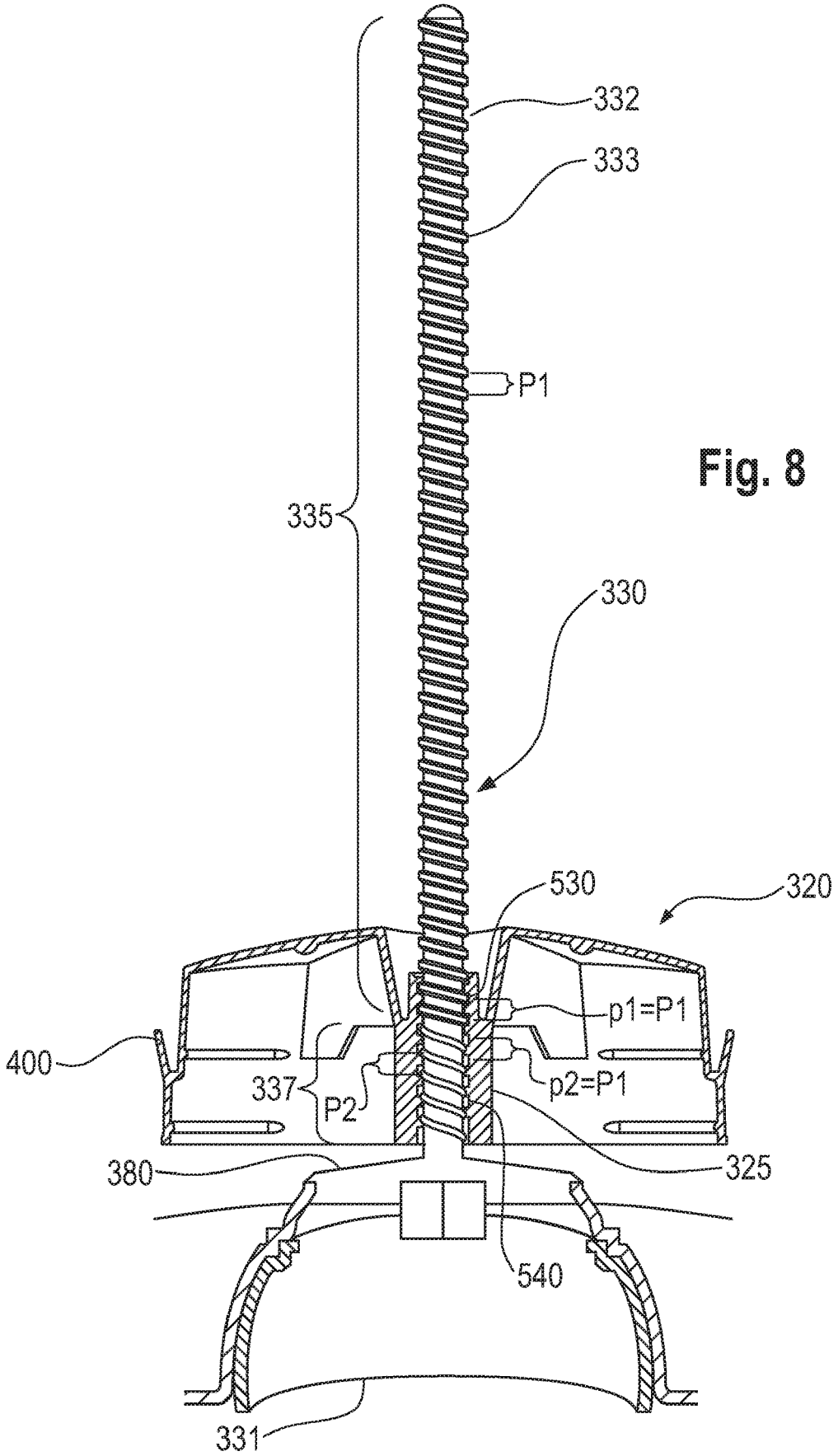
FIG. 8 is a detail, cross sectional view of a screw assembly engaged with a movable elevator platform of the dispensing package of FIG. 7.

As shown in FIG. 7 and FIG. 8, the spindle 332 may comprise a first external thread portion 335 having a first pitch P1; and a second external thread portion 337 having a second pitch P2. However, the movable elevator platform 320 may comprise a coupling sleeve 325 having internal threads having first and second internal thread portions 530, 540 having the same pitch P1 as the one of the first external thread portion 335 of the spindle 332.

In that case, when a user is actuating the screw base 331 of the screw assembly 330 (the operating button for the user), i.e. when a rotational force is applied to the screw base 331 by a user, the screw assembly 330, including the spindle 332, rotates causing the external threads 330 to rotate within the coupling sleeve 325 and moving the movable elevator platform 320 in a linear direction along the longitudinal axis L of the dispensing package 100.

First, because the second internal thread portion 540 of the movable elevator platform 320 has not the same pitch as the second external thread portion 337 of the spindle 332, the external threads of the second external thread portion 337 cross-thread with the internal threads of the second internal thread portion 540. In that case, the external threads of the second external thread portion 337 have misaligned threads with the internal threads of the second internal thread portion 540. As the second pitch P2 of the second external thread portion 337 is larger than the first pitch P1 of the first external thread portion 335, the movable elevator platform 320 is moved with a greater advance towards the top opening 160 of the product chamber 110. Hence, the empty space can be overcome and the first dose of the consumer care product can be dispensed more quickly. As the coupling sleeve 325 of the movable elevator platform 320 comprises internal threads, the platform 320 when moving in a linear direction along the longitudinal axis L of the dispensing package 100, is stabilized and the risk of having the platform 320 rocking is also prevented.

In that preferred execution, because the external threads of the second external thread portion 337 of the spindle 332 cross-thread with the internal threads of the second internal thread portion 540 of the coupling sleeve 325, the user may slightly feel that he needs some more torque to rotate the screw base 331, however, the problem of the empty space is readily overcome though.

When cross-threading is needed, i.e. in the case when the external threads of the second external thread portion 337 cross-thread with the internal threads of the second internal thread portion 540, it may be most beneficial to the user to have as little rotational torque as possible. This can be best managed by making the cross-threading features of the external threads of the second external thread portion 337 and the internal threads of the second internal thread portion 540 readily prone to cross thread. A number of ways to minimize the rotational torque may include the use of a softer material to be cross threaded and a harder material doing the cross-threading.

The internal threads of the second internal thread portion 540 may comprise a material having a first flexural modulus. The external threads of the second external thread portion 337 may comprise a material having a second flexural modulus. The first flexural modulus may be equal or less that the second flexural modulus. This will enable the external threads of the second external thread portion 337 of the spindle 332 to readily cross-thread the internal threads of the second internal thread portion 540 of the movable elevator platform 320 and ensure an optimized balance of lower torque with correctly functioning elevator movement.

Other examples of how the cross-threading can be optimized may include having thinner widths, thicknesses, or cross-sectional areas of the external threads of the second external thread portion 337 cross-threading with the internal threads of the second internal thread portion 540. Hence, the resistance to being cross threaded can be minimized while still enabling the movable elevator platform 320 to translate at the rate desired; typically at the second pitch P2 rate.

The cross-threading interaction may be achieved by allowing either the movable elevator platform 320 or the spindle 332 to cross thread each other interchangeably as desired. For this, the external threads of the second external thread portion 337 of the spindle 332 may be more or less stiff than the internal threads of the second internal thread portion 540 of the movable elevator platform 320 for optimizing consumer rotational torque.

To decrease the feeling that more torque is required to actuate the screw assembly for the first time, alternatively, the second external thread portion 337 of the screw assembly 330 may preferably engage with the second internal thread portion 540 of the movable elevator platform 320 along the inner surface 550 of the movable elevator platform 320 such that the second pitch p2 of the second internal thread portion 540 and the second pitch P2 of the second external thread portion 337 are the same.

The first pitch P1 may range 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

Figure 9:
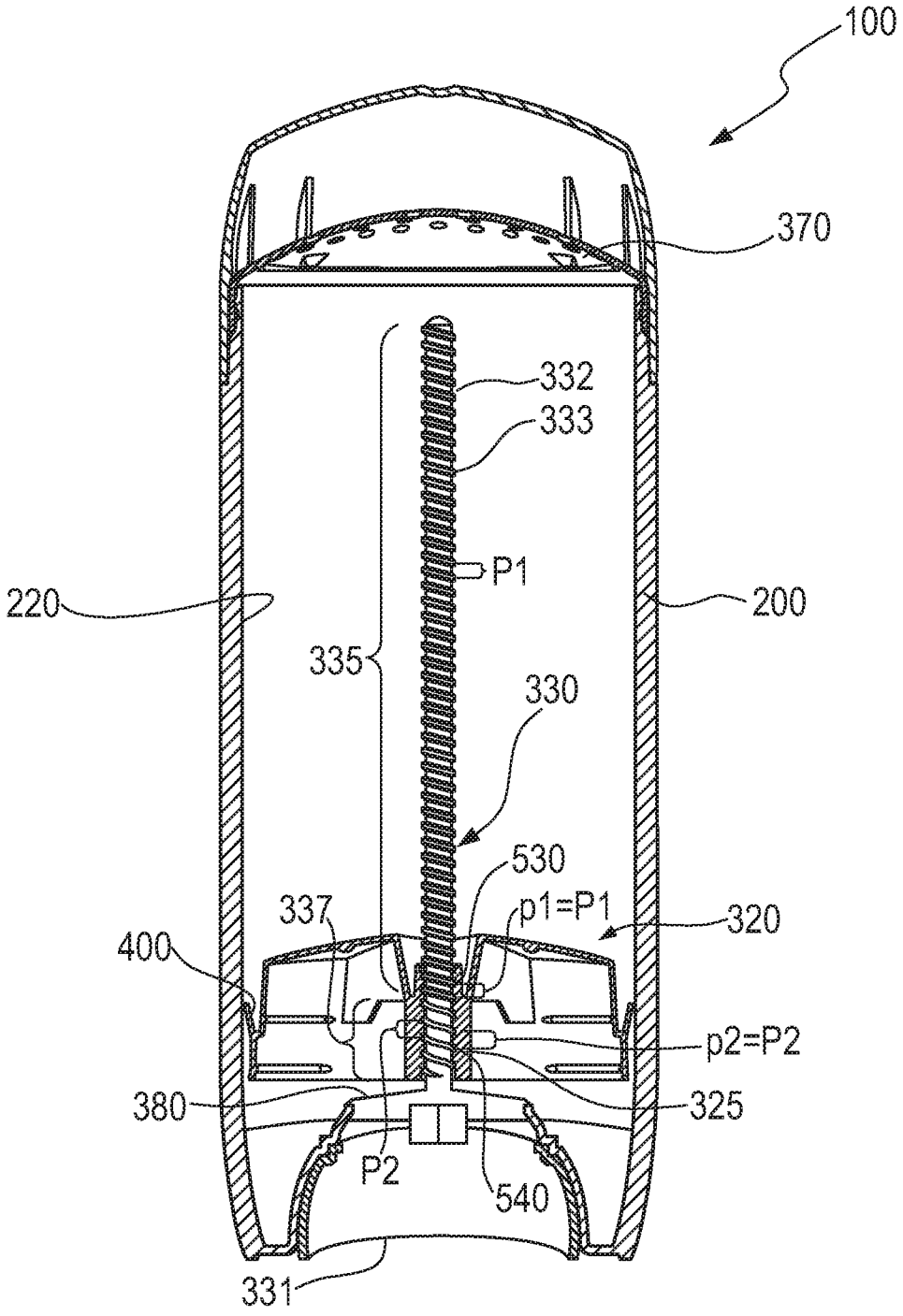
FIG. 9 is a cross sectional view of another dispensing package according to one or more aspects.
Figure 10:
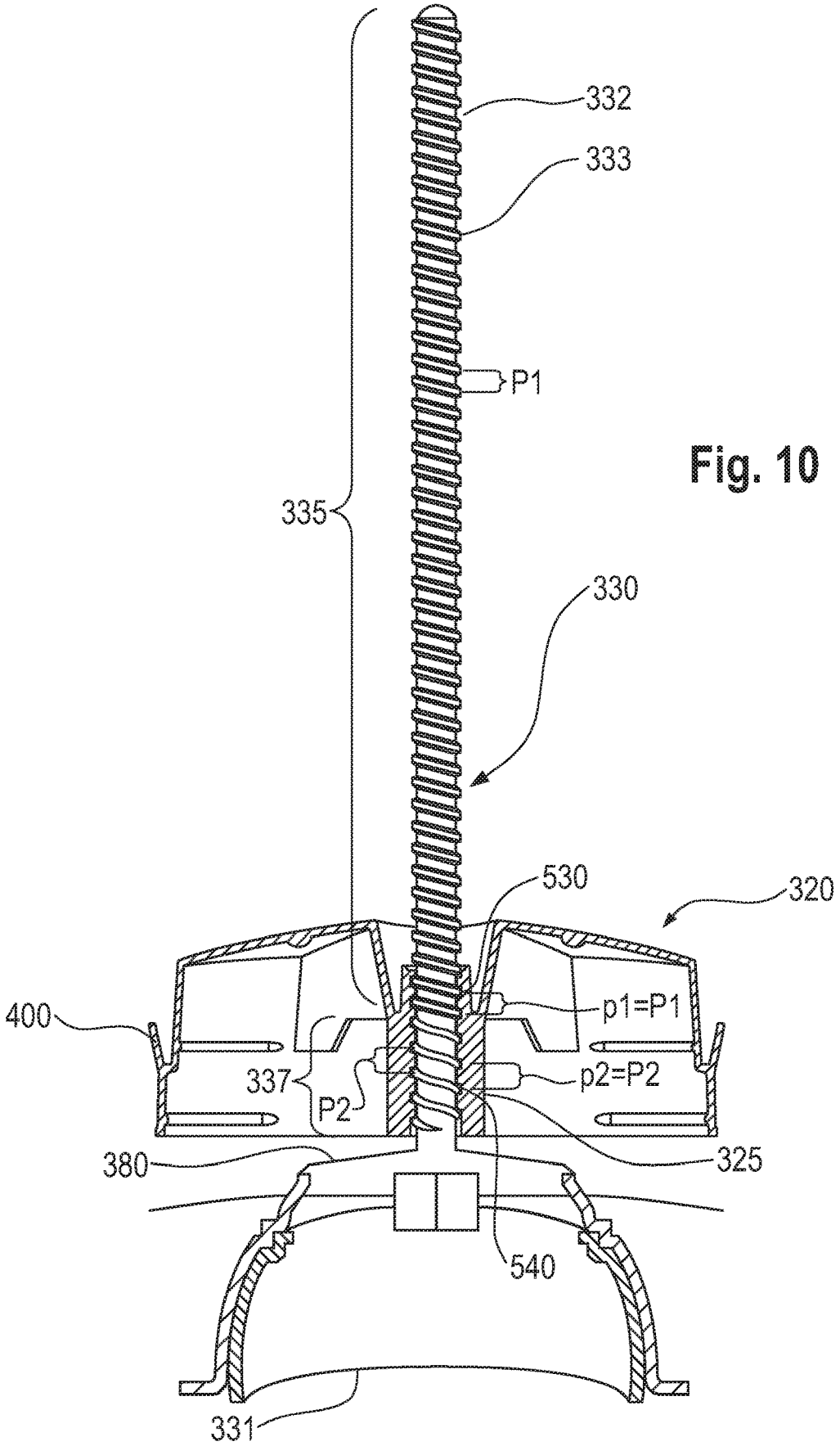
FIG. 10 is a detail, cross sectional view of a screw assembly engaged with a movable elevator platform of the dispensing package of FIG. 9.

As shown in FIG. 9 and FIG. 10, the internal threads of the second internal thread portion 540 of the coupling sleeve 325 match with the external threads of the second external thread portion 337 (as p2=P2). Also, the internal threads of the first internal thread portion 530 of the coupling sleeve 325 match with the external threads of the first external thread portion 335 (as p1=P1). The movable elevator platform 320 first engages with the second external thread portion 337 of the spindle 332 and then with the first external thread portion 335 of the spindle 332 when the user continues applying a rotational force to the screw base 331. Because the respective portions of the spindle 332 match with the respective portions of the coupling sleeve 325, less torque is needed to be applied when actuating the screw base 331 of the screw assembly 330 in order to make advance the platform 320 in a linear direction along the longitudinal axis L of the dispensing package 100 towards the top opening 160 of the product chamber 110.

One skilled in the art can elaborate different kinds of spindles 332 able to engage with the respective movable elevator platforms 320 as long as:

- the second pitch P2 of the second external thread portion 337 is larger than the first pitch P1 of the first external thread portion 335;
- the first pitch p1 of the first internal thread portion 530 and the first pitch P1 of the first external thread portion 335 are the same; and
- the second pitch p2 of the second internal thread portion 540 is comprised between the first pitch P1 of the first external thread portion 335 and the second pitch P2 of the second external thread portion 337.

These features can advantageously help to displace quicker the movable elevator platform 320 upwards in the product chamber 110 in order to overcome the empty space while preventing any rocking of the platform 320 at the same time.

Furthermore, as illustrated in FIG. 7, and FIG. 8, but also with FIG. 9 and FIG. 10 the dispensing package 100 may comprise a spindle 332 comprising a first external thread portion 335 having a major diameter $MD_1$; and a second external thread portion 337 also having the major diameter $MD_1$. The dispensing package 100 may also comprise a movable elevator platform 320 comprising a coupling sleeve 325 wherein the first internal thread portion 530 has a major diameter $MD_{10}$; and wherein the second internal thread portion 540 has also the major diameter $MD_{10}$. In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the internal threads of the second internal thread portion 540 of the movable elevator platform 320. Hence, the spindle 332 may comprise one single major diameter $MD_1$, as well as the coupling sleeve 325 may comprise one single major diameter $MD_{10}$.

Here, the actuation of the screw assembly 330 requires less torque to be applied by the consumer. The screw assembly is then easier to turn.

The preferred execution as illustrated in FIG. 7 and FIG. 8 is also relatively easy to manufacture. In that case, the spindle 332 has one single major diameter that matches with the single major diameter of the coupling sleeve 325 of the platform 320. Indeed, the coupling sleeve 325 of the movable elevator platform 320 can be made with one single screw having one single major diameter $MD_{10}$ and the pitch of value P1 (the pitch P1 of the first external thread portion 335 of the spindle 332).

When the second pitch p2 of the second internal thread portion 540 and the second pitch P2 of the second external thread portion 337 are the same, as shown for instance in FIG. 9 and FIG. 10, the external threads of the first external thread portion 335 match with the internal threads of the first internal thread portion 530. Also, the external threads of the second external thread portion 337 match with the internal threads of the second internal thread portion 540.

Preferably, when matching in this case, the major diameter $MD_1$ of the first external thread portion 335 and the second external thread portion 337 of the spindle 332 may be typically smaller than the major diameter $MD_{10}$ of the respective first internal thread portion 530 and the second internal thread portion 540 of the coupling sleeve 325.

Alternatively, the dispensing package may comprise the spindle 332 wherein the first external thread portion 335 has a major diameter $MD_1$ and wherein the second external thread portion 337 has a major diameter $MD_2$. The major diameter $MD_2$ of the second external thread portion 337 is larger than the major diameter $MD_1$ of the first external thread portion 335.

The dispensing package may comprise the coupling sleeve 325 of the movable elevator platform 320, wherein the first internal thread portion 530 has a major diameter $MD_{10}$ and wherein the second internal thread portion 540 has a major diameter $MD_{20}$. The major diameter $MD_{20}$ of the second internal thread portion 540 is larger than the major diameter $MD_{10}$ of the first internal thread portion 530.

In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the internal threads of the second internal thread portion 540 of the movable elevator platform 320.

As set out above, the first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the second internal thread portion 540 of the movable elevator platform 320 along the inner surface 550 of the movable elevator platform 320 such that the second pitch p2 of the second internal thread portion 540 is comprised between the first pitch P1 of the first external thread portion 335 and the second pitch P2 of the second external thread portion 337.

A dispensing package 100 may comprise a spindle 332 comprising a first external thread portion 335 having a first pitch P1; and a second external thread portion 337 having a second pitch P2. The second pitch P2 is larger than the first pitch P1. Also, the first external thread portion 335 may have a major diameter $MD_1$ and wherein the second external thread portion 337 may have a major diameter $MD_2$. The major diameter $MD_2$ of the second external thread portion 337 is larger than the major diameter $MD_1$ of the first external thread portion 335.

At the same time, the dispensing package 100 may comprise a movable elevator platform 320 which comprises a coupling sleeve 325 having an inner surface 550. The coupling sleeve 325 may support internal threads having a first internal thread portion 530 having a first pitch p1 and a second internal thread portion 540 having a second pitch p2. The first internal thread portion 530 may have a major diameter $MD_{10}$ and the second internal thread portion 540 may have a major diameter $MD_{20}$. The major diameter $MD_{20}$ of the second internal thread portion 540 may be larger than the major diameter $MD_{10}$ of the first internal thread portion 530.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the second internal thread portion 540 of the movable elevator platform 320 along the inner surface 550 of the movable elevator platform 320 such that the second pitch p2 of the second internal thread portion 540 is comprised between the first pitch P1 of the first external thread portion 335 and the second pitch P2 of the second external thread portion 337.

Preferably, the second external thread portion 337 of the screw assembly 330 may preferably engage with the second internal thread portion 540 of the movable elevator platform 320 along the inner surface 550 of the movable elevator platform 320 such that the second pitch p2 of the second internal thread portion 540 and the first pitch P1 of the first external thread portion 335 are the same.

Figure 11:
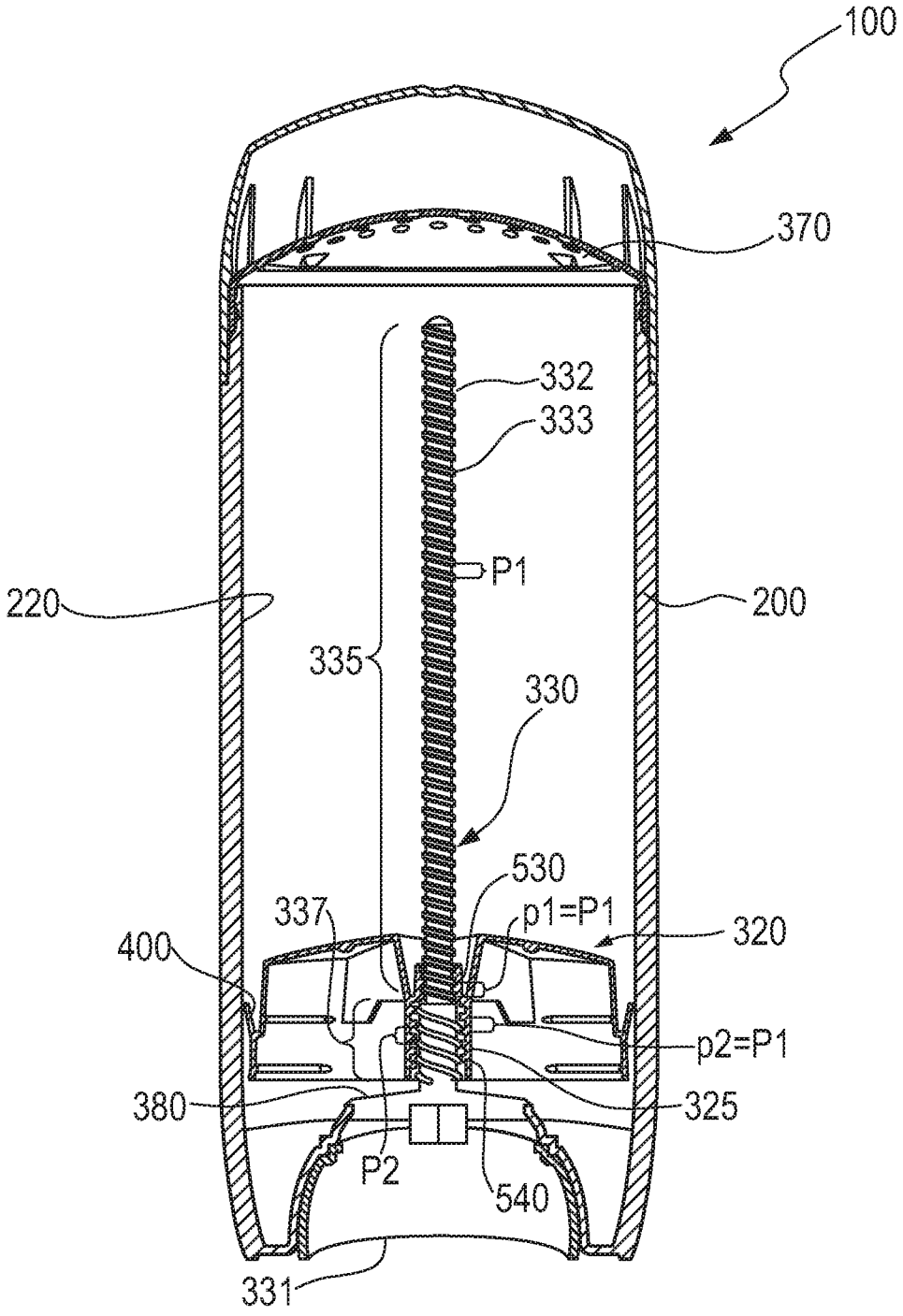
FIG. 11 is a cross sectional view of another dispensing package according to one or more aspects.
Figure 12:
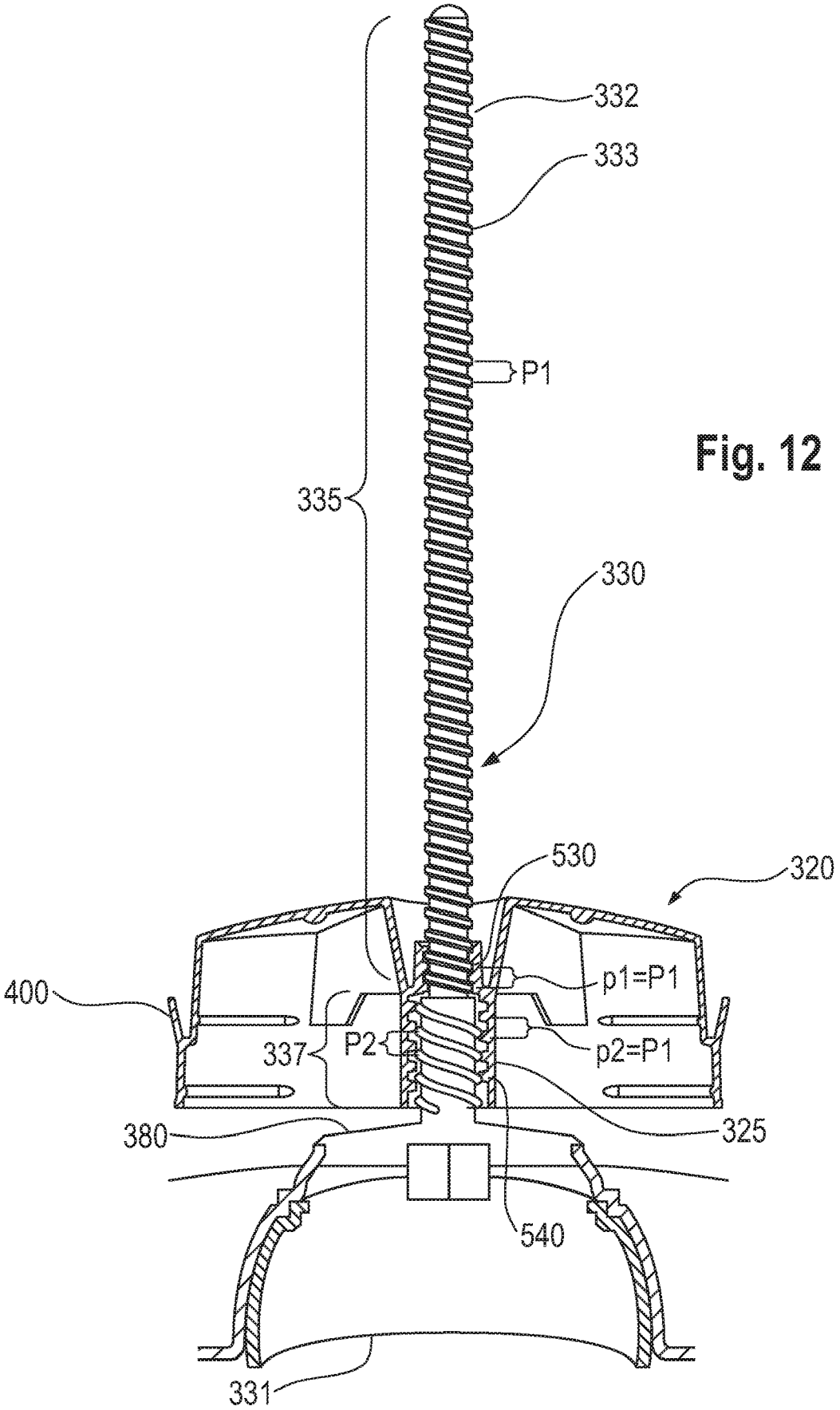
FIG. 12 is a detail, cross sectional view of a screw assembly engaged with a movable elevator platform of the dispensing package of FIG. 11.

FIG. 11 and FIG. 12 illustrate a dispensing packaging 100 comprising a spindle 332 having a first external thread portion 335 comprising a first pitch P1 and a first major diameter $MD_1$ and a second external thread portion 337 comprising a second pitch P2 and a second major diameter $MD_2$. The second pitch P2 is larger than the first pitch P1. The major diameter $MD_2$ of the second external thread portion 337 is larger than the major diameter $MD_1$ of the first external thread portion 335.

Also, the dispensing packaging 100 comprises a coupling sleeve 325 of a movable elevator platform 320 including a first internal thread portion 530 having a first pitch p1 and a major diameter $MD_{10}$; and a second internal thread portion 540 having a second pitch p2 and a major diameter $MD_{20}$. The major diameter $MD_{20}$ of the second internal thread portion 540 is larger than the major diameter $MD_{10}$ of the first internal thread portion 530.

Here, the first pitch p1 of the first internal thread portion 530 and the first pitch P1 of the first external thread portion 335 are the same. Also, the second pitch p2 of the second internal thread portion 540 and the first pitch P1 of the first external thread portion 335 are the same.

Because of the respective larger major diameters of the second internal thread portion 540 and the second external thread portion 337, the empty space will be readily and quickly addressed. As the second external thread portion 337 of the spindle 332 having the second pitch P2 cross-threads the second internal thread portion 540 of the coupling sleeve 325 having the second pitch p2 being the first pitch P1, an acceptable torque might be felt by the consumer.

Nevertheless, such execution as illustrated in FIG. 11 and FIG. 12 can be relatively easy to manufacture. Indeed, the coupling sleeve 325 of the movable elevator platform 320 can be made with one single screw spindle having the first external thread portion having a major diameter $MD_{10}$ and the second external thread portion having a major diameter $MD_{20}$; and the pitch of value P1 (the pitch P1 of the first external thread portion 335 of the spindle 332).

Hence, in order to overcome the slight torque feeling by the consumer, more preferably, the second external thread portion 337 of the screw assembly 330 may preferably engage with the second internal thread portion 540 of the movable elevator platform 320 along the inner surface 550 of the movable elevator platform 320 such that the second pitch p2 of the second internal thread portion 540 and the second pitch P2 of the second external thread portion 337 are the same.

Figure 13:
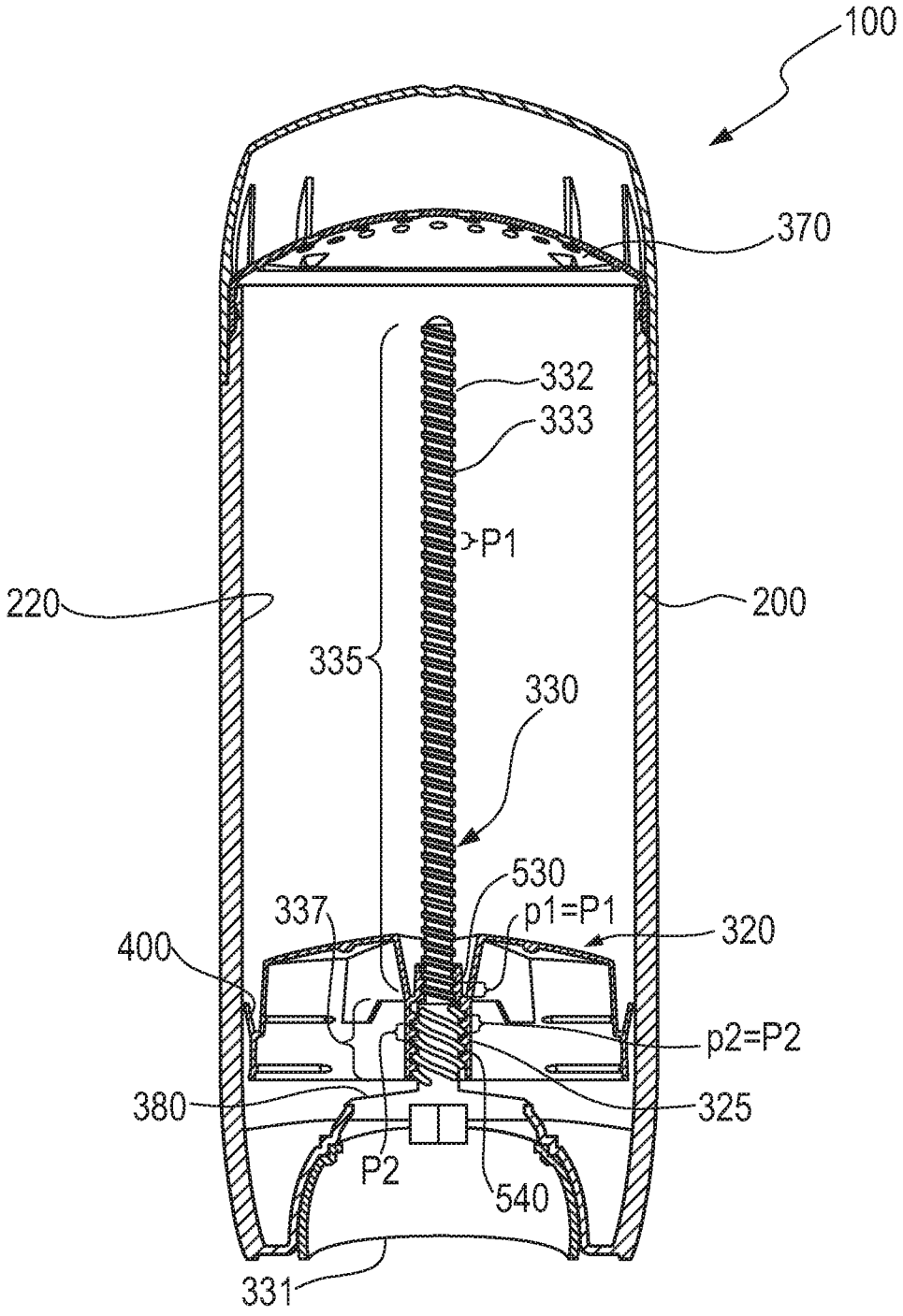
FIG. 13 is a cross sectional view of another dispensing package according to one or more aspects.
Figure 14:
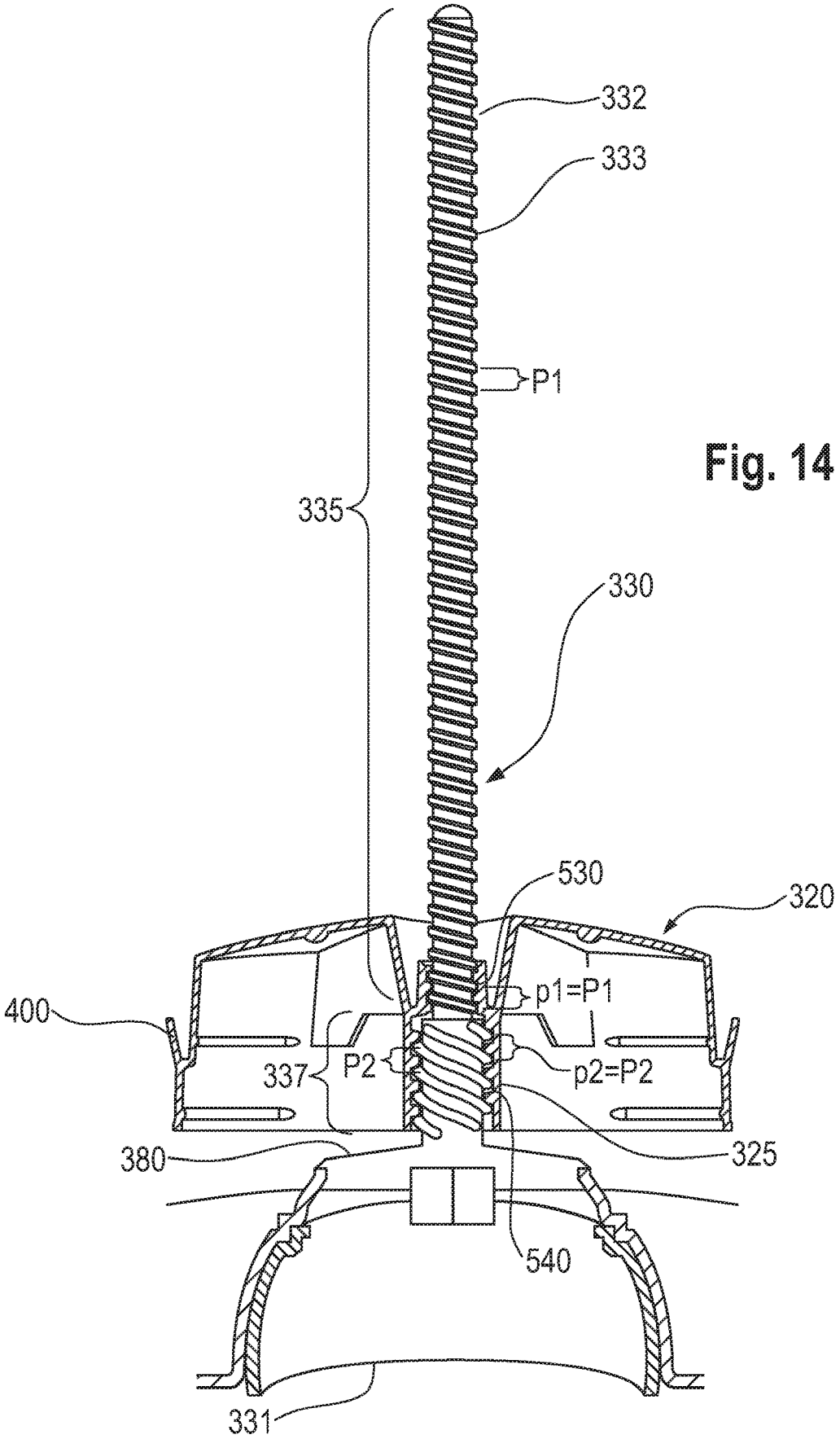
FIG. 14 is a detail, cross sectional view of a screw assembly engaged with a movable elevator platform of the dispensing package of FIG. 13.

FIG. 13 and FIG. 14 illustrate a dispensing packaging 100 comprising a spindle 332 having a first external thread portion 335 comprising a first pitch P1 and a first major diameter $MD_1$ and a second external thread portion 337 comprising a second pitch P2 and a second major diameter $MD_2$. The second pitch P2 is larger than the first pitch P1. The major diameter $MD_2$ of the second external thread portion 337 is larger than the major diameter $MD_1$ of the first external thread portion 335.

Also, the dispensing packaging 100 comprises a coupling sleeve 325 of a movable elevator platform 320 including a first internal thread portion 530 having a first pitch p1 and a major diameter $MD_{10}$; and a second internal thread portion 540 having a second pitch p2 and a major diameter $MD_{20}$. The major diameter $MD_{20}$ of the second internal thread portion 540 is larger than the major diameter $MD_{10}$ of the first internal thread portion 530.

Here, the first pitch p1 of the first internal thread portion 530 and the first pitch P1 of the first external thread portion 335 are the same. But now, the second pitch p2 of the second internal thread portion 540 and the second pitch P2 of the second external thread portion 337 are the same.

Even if this execution may be more challenging to manufacture, the execution as illustrated for instance in FIG. 13 and FIG. 14 can be the most convenient one for the consumer.

In this execution, the external threads of the first external thread portion 335 match with the internal threads of the first internal thread portion 530. Also, the external threads of the second external thread portion 337 match with the internal threads of the second internal thread portion 540. Almost no resistance is felt by the user when actuating the screw base 331 of the screw assembly 330.

Preferably, when matching in this case, the major diameter of external threads may be typically smaller that the major diameter of the internal threads. Hence, the major diameter $MD_1$ of the first external thread portion 335 of the spindle 332 may be smaller than the major diameter $MD_{10}$ of the first internal thread portion 530 of the coupling sleeve 325. Also, the major diameter $MD_2$ of the second external thread portion 337 of the spindle 332 may be smaller than the major diameter $MD_{20}$ of the second internal thread portion 540 of the coupling sleeve 325.

Figure 15:
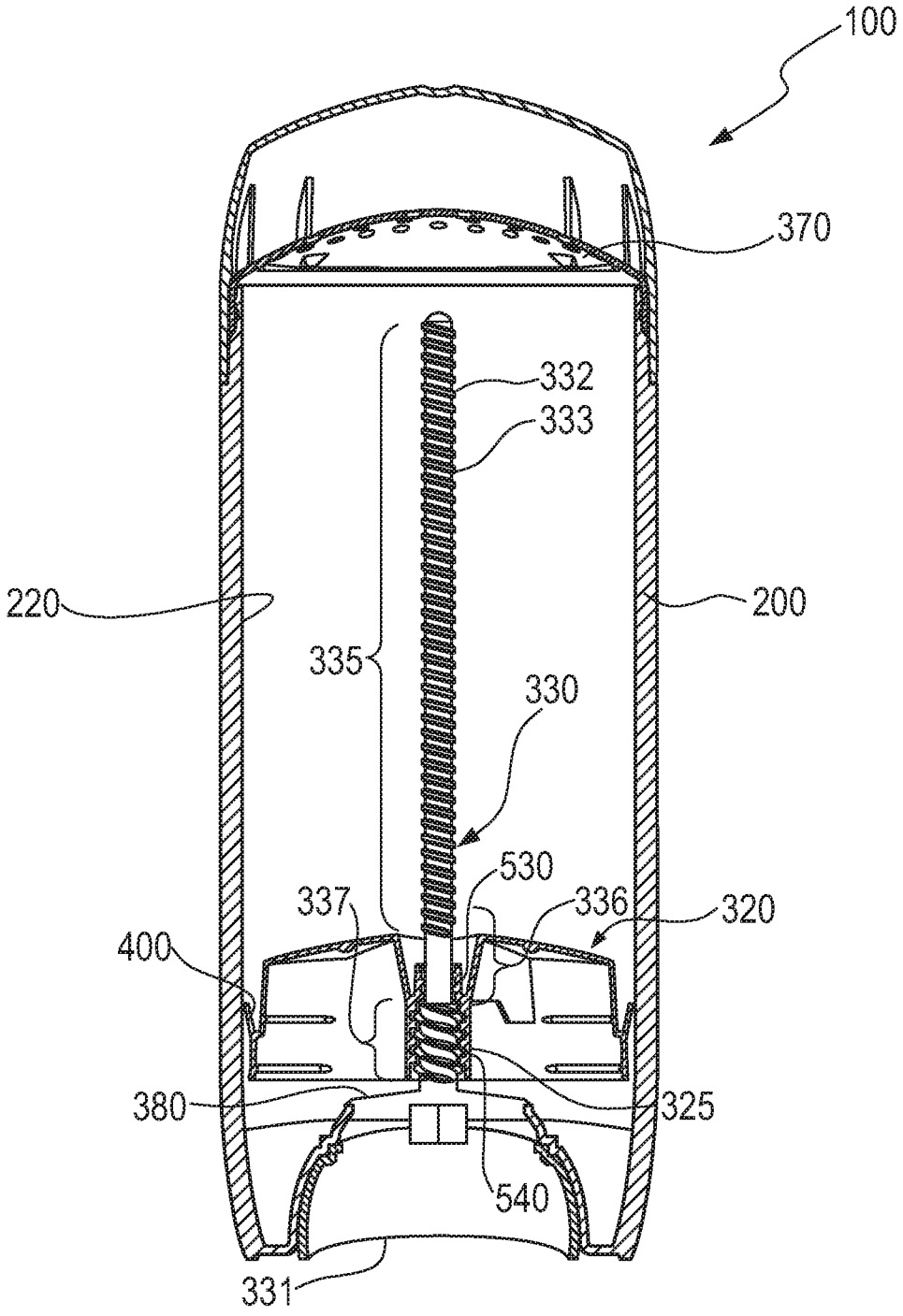
FIG. 15 is a cross sectional view of another dispensing package according to one or more aspects.
Figure 16:
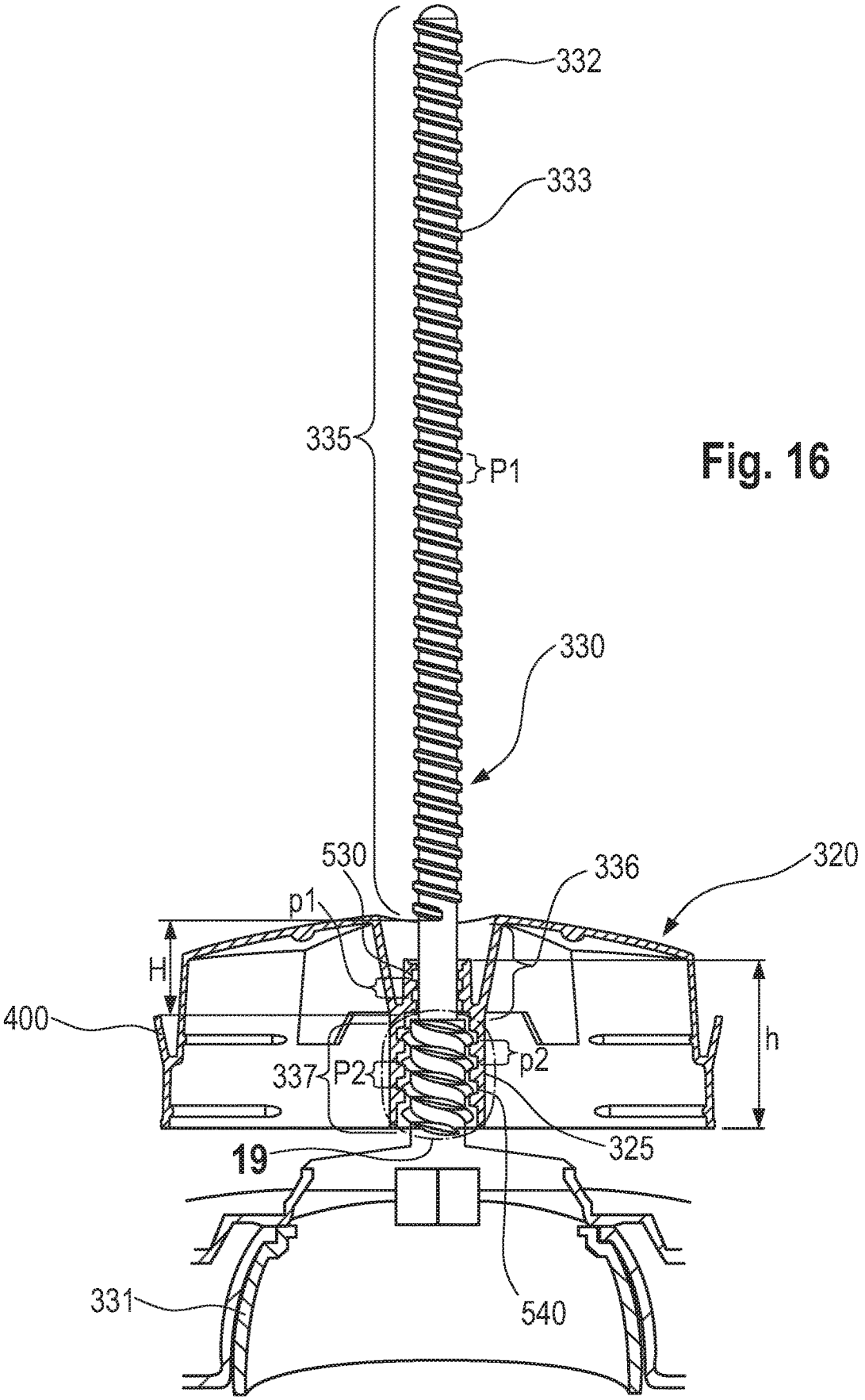
FIG. 16 is a detail, cross sectional view of a screw assembly engaged with a movable elevator platform of the dispensing package of FIG. 15.

Furthermore, the screw assembly 330 may comprise a spindle 332 including a third non-threaded portion 336 located between the first external thread portion 335 and the second external thread portion 337, as shown in FIG. 15 and FIG. 16 for illustrating an example.

In FIG. 15 and FIG. 16, the movable elevator platform 320 is located at the proximity of the first end 260 of the jacket, i.e. the bottom opening 260 of the outer jacket or the bottom opening 170 of the product chamber 110. The second external thread portion 337 of the spindle 332 can engage with the second internal thread portion 540 of the coupling sleeve 325.

Figure 17:
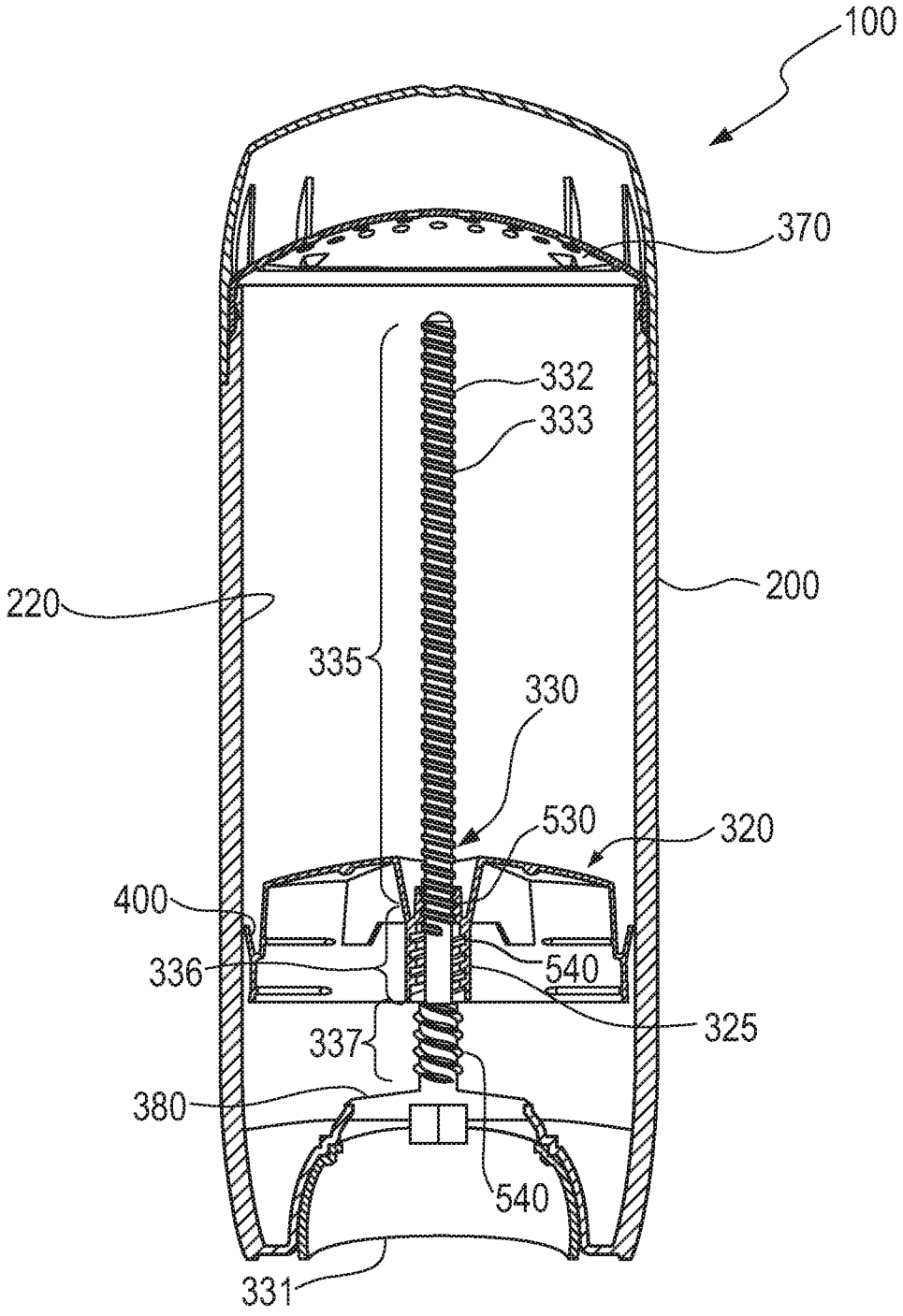
FIG. 17 is a cross sectional view of the dispensing package of FIG. 15 when the screw base has been actuated by the consumer.
Figure 18:
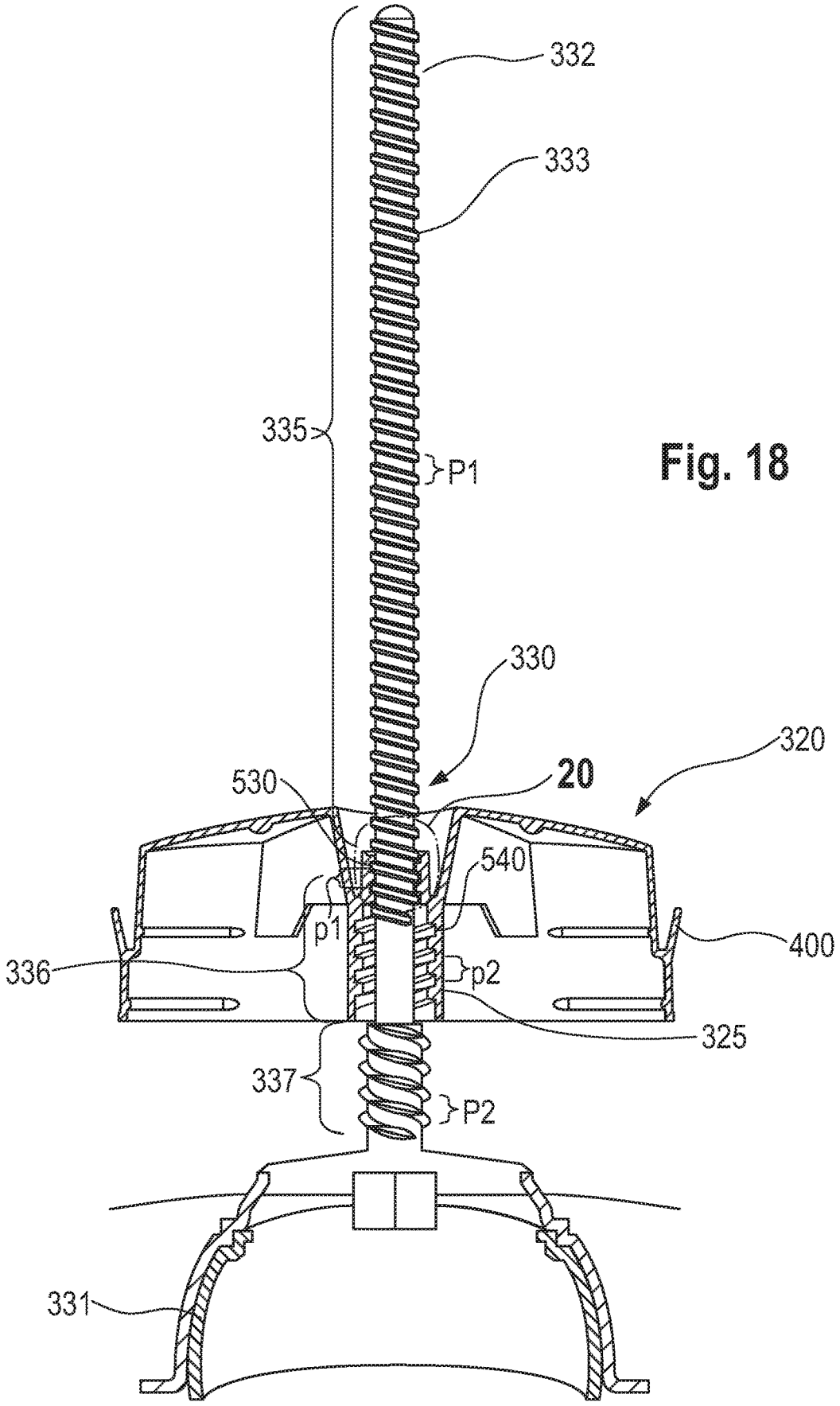
FIG. 18 is a detail, cross sectional view of a screw assembly engaged with a movable elevator platform of the dispensing package of FIG. 17.

When the user applies some torque at the screw base 331 of the screw assembly 330, the spindle 332 rotates which causes the movable elevator platform 320 to advance in a linear direction along the longitudinal axis L of the dispensing package 100. In FIG. 17 and in FIG. 18, the spindle 332 has a third non-threaded portion 336 which is exaggerated in terms of height. When the second external thread portion 337 of the spindle 332 is almost disengaging with the second internal thread portion 540 of the coupling sleeve 325, the first external thread portion 335 of the spindle 332 starts engaging with the first internal thread portion 530 of the coupling sleeve 325. The empty space has been overcome at this stage. The first dose of the consumer care product has been then delivered. Now, when the user continues actuating the screw base 331 of the screw assembly 330, further dose will be provided in an accurate manner, in part due to the first pitch P1 of the first external thread portion 335. The presence of the third non-threaded portion 336 allows avoiding the external threads of the respective first and second external thread portions 335, 337 engaging with the corresponding internal threads of the respective first and second internal thread portions 530, 540 at the same time. The third non-threaded portion 336 can help to avoid the spindle 332 rotating without no advancement of the platform 320 in a linear direction along the longitudinal axis L of the dispensing package 100 towards the top opening 160 of the product chamber 110.

The third non-threaded portion 336 may have preferably a height H as measured along the longitudinal axis L. The coupling sleeve 325 of the movable elevator platform 320 may have a height h as measured along the longitudinal axis L. The height h of the coupling sleeve 325 comprises, or may preferably consist of the height of the first and second internal thread portions (530, 540). The height H of the third non-threaded portion 336 may be above the second pitch P2 of the second external thread portion 337 of the spindle 332 and less than the height h of the coupling sleeve 325 of the movable elevator platform 320.

The height H of the third non-threaded portion 336 may range from 0.1 inch to 1 inch (from 2.54 mm to 25.4 mm), preferably from 0.2 inch to 0.8 inch (from 5.08 mm to 20.32 mm), more preferably from 0.25 inch to 0.75 inch (from 6.35 mm to 19.05 mm).

Figure 19:
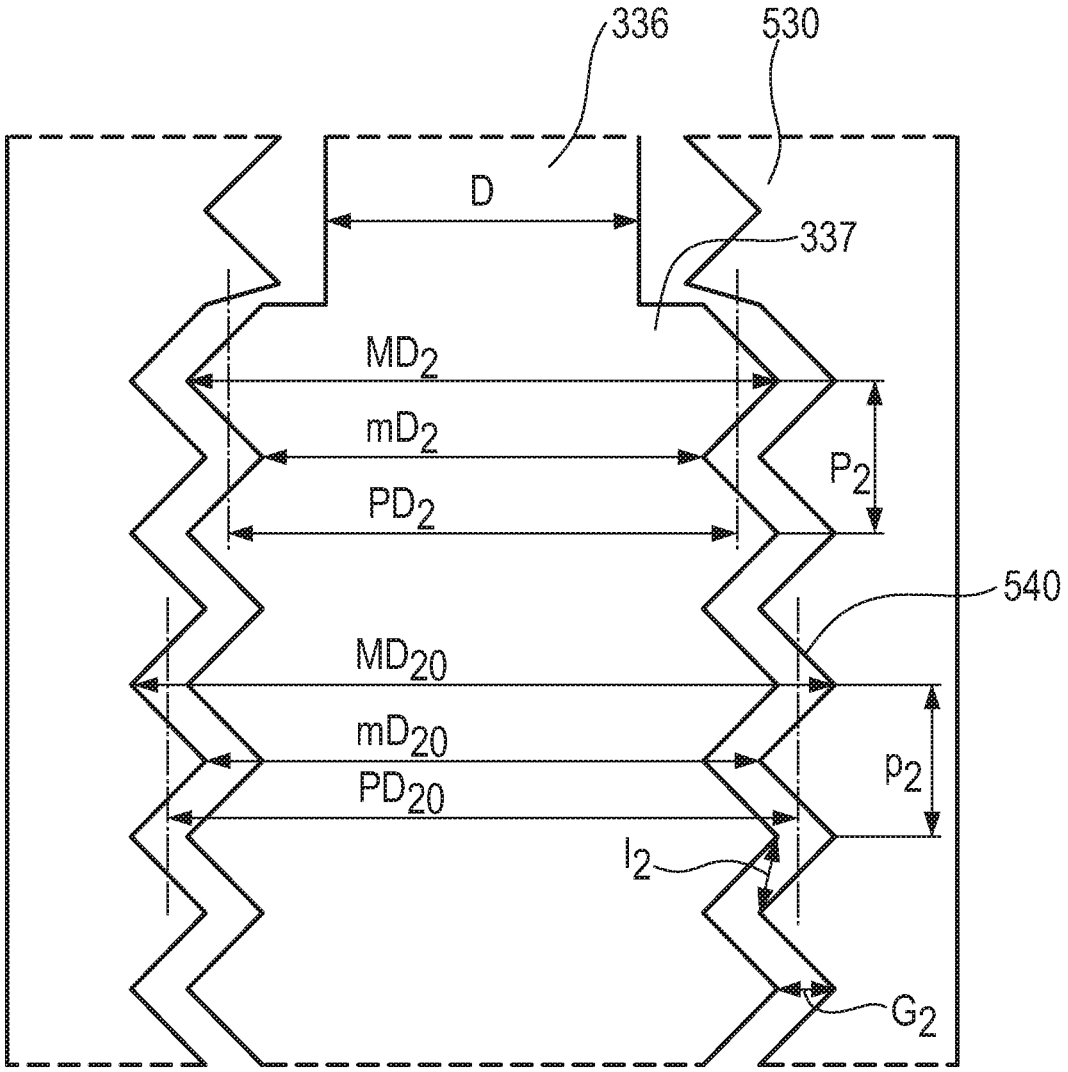
FIG. 19 is a detail, cross sectional view of the second external thread portion engaged with the second internal thread portion of the dispensing package of FIG. 16.

As shown for instance in a FIG. 19, the second external thread portion 337 of the spindle 332 may have a major diameter $MD_2$, a minor diameter $mD_2$ and a pitch diameter $PD_2$. The second internal thread portion 540 of the coupling sleeve 325 of the platform 320 may have a major diameter $MD_{20}$, a minor diameter $mD_{20}$ and a pitch diameter $PD_{20}$.

The major diameter $MD_2$ of the second external thread portion 337 of the spindle 332 may range from 0.1 inch to 1 inch (from 2.54 mm to 25.4 mm), preferably from 0.2 inch to 0.8 inch (from 5.08 mm to 20.32 mm), more preferably from 0.25 inch to 0.5 inch (from 6.35 mm to 12.7 mm).

The minor diameter $mD_2$ of the second external thread portion 337 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.2 inch (from 2.54 mm to 5.08 mm).

The major diameter $MD_{20}$ of the second internal thread portion 540 of the coupling sleeve 325 of the movable elevator platform 320 may range from 0.1 inch to 1 inch (from 2.54 mm to 25.4 mm), preferably from 0.2 inch to 0.8 inch (from 5.08 mm to 20.32 mm), more preferably from 0.25 inch to 0.5 inch (from 6.35 mm to 12.7 mm).

The minor diameter $mD_{20}$ of the second internal thread portion 540 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.25 inch (from 2.54 mm to 6.35 mm).

When the second pitch p2 of the second internal thread portion 540 and the second pitch P2 of the second external thread portion 337 are the same, the external threads of the second external thread portion 337 match with the internal threads of the second internal thread portion 540.

Then, the major diameter $MD_2$ of the second external thread portion 337 of the spindle 332 may be typically smaller than the major diameter $MD_{20}$ of the second internal thread portion 540 of the coupling sleeve 325. Also, the minor diameter $mD_2$ of the second external thread portion 337 of the spindle 332 may be typically smaller than the minor diameter $mD_{20}$ of the second internal thread portion 540 of the coupling sleeve 325. Also, the pitch diameter $PD_2$ of the second external thread portion 337 of the spindle 332 may be typically smaller than the pitch diameter $PD_{20}$ of the second internal thread portion 540 of the coupling sleeve 325.

Figure 20:
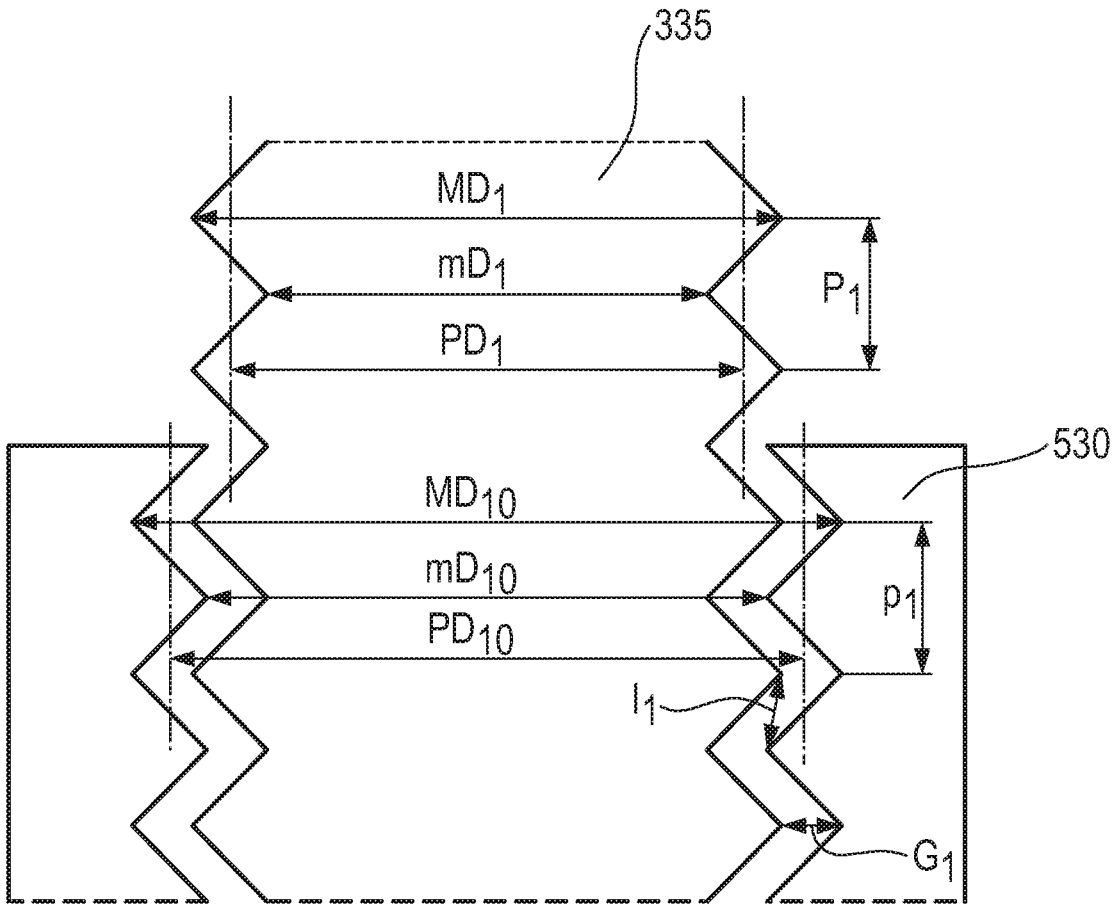
FIG. 20 is a detail, cross sectional view of the first external thread portion engaged with the first internal thread portion of the dispensing package of FIG. 18.

As shown for instance in a FIG. 20, the first external thread portion 335 of the spindle 332 may have a major diameter $MD_1$, a minor diameter $mD_1$ and a pitch diameter $PD_1$. The first internal thread portion 530 of the coupling sleeve 325 of the platform 320 may have a major diameter $MD_{10}$, a minor diameter $mD_{10}$ and a pitch diameter $PD_{10}$.

The major diameter $MD_1$ of the first external thread portion 335 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The minor diameter $mD_1$ of the second external thread portion 337 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The major diameter $MD_{10}$ of the first internal thread portion 530 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The minor diameter $mD_{10}$ of the first internal thread portion 530 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.25 inch (from 2.54 mm to 6.35 mm).

When the first pitch p1 of the first internal thread portion 530 and the first pitch P1 of the first external thread portion 335 are the same, the external threads of the first external thread portion 335 match with the internal threads of the first internal thread portion 530.

Then, the major diameter $MD_1$ of the first external thread portion 335 of the spindle 332 may be typically smaller than the major diameter $MD_{10}$ of the first internal thread portion 530 of the coupling sleeve 325. Also, the minor diameter $mD_1$ of the first external thread portion 335 of the spindle 332 may be typically smaller than the minor diameter $mD_{10}$ of the first internal thread portion 530 of the coupling sleeve 325. Also, the pitch diameter $PD_1$ of the first external thread portion 335 of the spindle 332 may be typically smaller than the pitch diameter $PD_{10}$ of the first internal thread portion 530 of the coupling sleeve 325.

The engagement between the spindle 332 of the screw assembly 330 with the coupling sleeve 325 of the movable elevator platform 320 may be further defined.

The first external thread portion 335 of the screw assembly 330 and the first internal thread portion 530 of the movable elevator platform 320 may comprise a first gap G1 (see FIG. 20). The first gap G1 is the distance between a crest of an external thread of the first external thread portion 335 and a nest of the proximate internal thread of the first internal thread portion 530, wherein the external and internal threads are coaxial to an axis perpendicular to the longitudinal axis. The first gap G1 may be from 0.001 inch (25.4 μam) to 0.020 inch (0.51 mm), preferably from 0.002 inch (50.8 μm) to 0.010 inch (0.25 mm), more preferably from 0.002 inch (50.8 μm) to 0.05 inch (1.27 mm).

The second external thread portion 337 of the screw assembly 330 and the second internal thread portion 540 of the movable elevator platform 320 may comprise a second gap G2 (See FIG. 19). The second gap G2 is the distance between a crest of an external thread of the second external thread portion 337 and a nest of the proximate internal thread of the second internal thread portion 540, wherein the external and internal threads are coaxial to an axis perpendicular to the longitudinal axis. The second gap G2 may be from 0.001 inch (25.4 μm) to 0.020 inch (0.51 mm), preferably from 0.002 inch (50.8 μm) to 0.010 inch (0.25 mm), more preferably from 0.005 inch (0.12 mm) to 0.010 inch (0.25 mm).

The first external thread portion 335 of the screw assembly 330 and the first internal thread portion 530 of the movable elevator platform 320 may comprise a first interference Nominal $I_1$ (see FIG. 20). The first interference Nominal $I_1$ is the distance between a crest of an external thread of the first external thread portion 335 and an adjacent crest of the proximate internal thread of the first internal thread portion 530, wherein the external and internal threads are coaxial to an axis perpendicular to the longitudinal axis. The first interference Nominal $I_1$ may be from 0.000 inch (0 mm) to 0.15 inch (3.85 mm), preferably from 0.005 inch (0.12 mm) to 0.030 inch (0.76 mm).

The second external thread portion 337 of the screw assembly 330 and the second internal thread portion 540 of the movable elevator platform 320 may comprise a second interference Nominal $I_2$ (see FIG. 19). The second interference Nominal $I_2$ is the distance between a crest of an external thread of the second external thread portion 337 and an adjacent crest of the proximate internal thread of the second internal thread portion 540, wherein the external and internal threads are coaxial to an axis perpendicular to the longitudinal axis. The second interference Nominal $I_2$ may be from 0.000 inch (0 mm) to 0.15 inch (3.85 mm), preferably from 0.005 inch (0.12 mm) to 0.030 inch (0.76 mm).

Optional Aspects of the Screw Assembly

Figure 21:
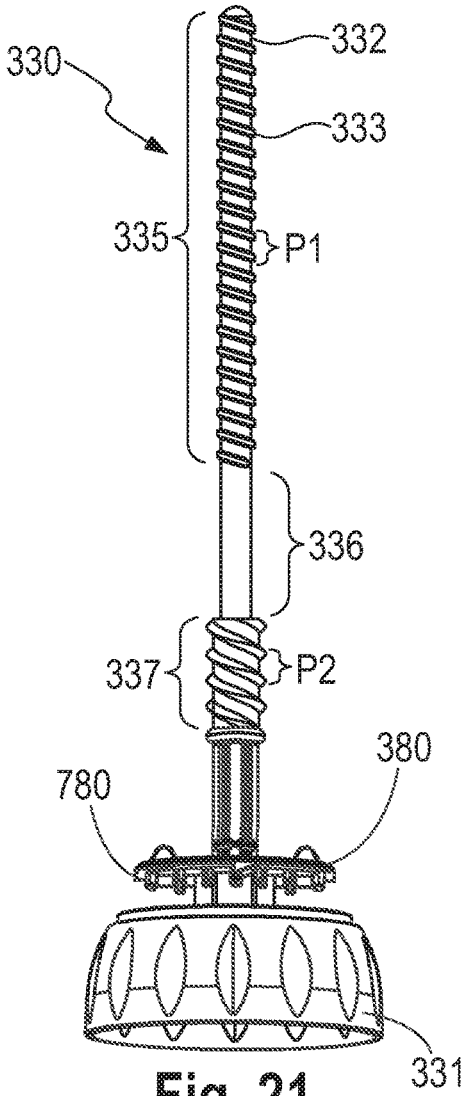
FIG. 21 is a perspective, front view of a screw assembly of a dispensing package according to one or more aspects.
Figure 22:
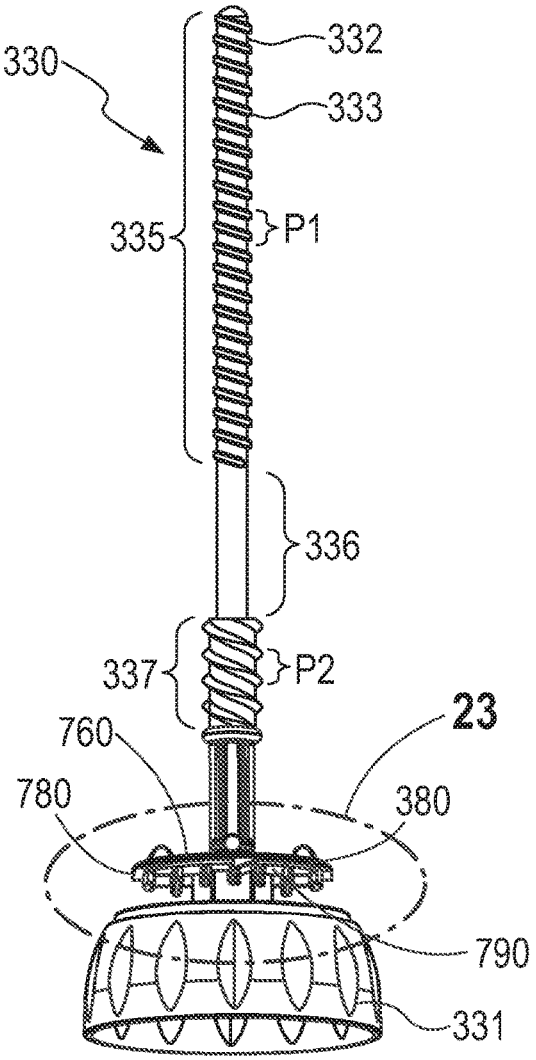
FIG. 22 is a perspective, back view of the screw assembly of FIG. 21.
Figure 23:
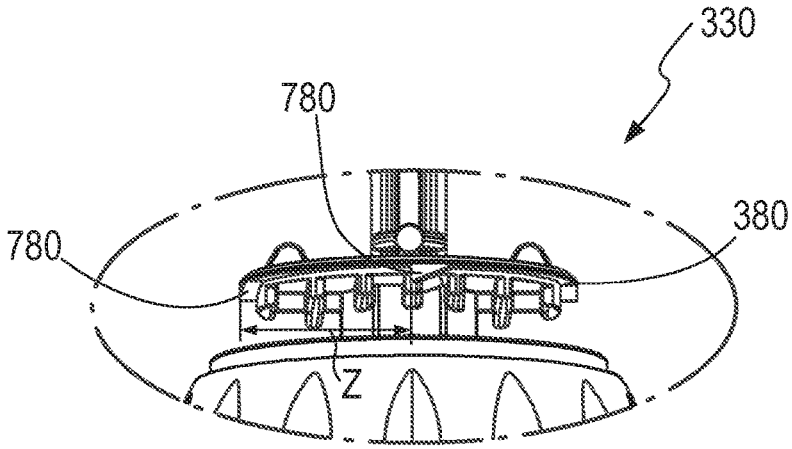
FIG. 23 is an enlarged view of an area within FIG. 22.
Figure 24:
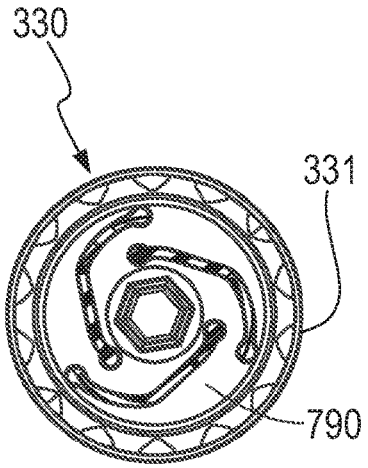
FIG. 24 is a bottom view of the screw assembly of FIG. 21.

As shown for instance in FIGS. 21 and 22, the screw assembly 330 may include a ratchet platform 380. The ratchet platform 380 may have a diameter from 10 mm to 40 mm (from 0.39 inch to 1.57 inch). The ratchet platform 380 may preferably have a diameter between 10 and 30 mm (0.39-1.18 inch). The ratchet platform 380 may be mounted to the screw assembly 330 or molded as a single part within the screw assembly 330. Because the ratchet platform 380 is fixed to the screw assembly 330, rotating the screw base 331 will likewise rotate the ratchet platform 380. The ratchet platform 380 may include a plurality of pawls 780. As shown in FIG. 23, the pawls 780 may have a spacing Z between each pawl 780. The size of the pawl 780, the number of pawls 780, and the spacing Z between the pawls 780 may be engineered so that no more than one pawl 780 is operatively associated with any given face 740 when the screw base 331 is not being engaged by a user. The spacing Z may be from 10 degrees to 360 degrees, preferably from 90 degrees to 180 degrees, more preferably about 90 degrees. The ratchet platform 380 may include from 1 to 40 pawls 780, preferably from 1 to 20 pawls 780, more preferably from 1 to 12 pawls 780. The ratchet 700 may not include any pawls 780. As shown in FIG. 24, when the ratchet platform 380 is included, the screw base 331 need not have an internal open configuration that allows for bottom filling such as when a closed end 790 is included because such a closed end 790 may restrict bottom filling.

Figure 25:
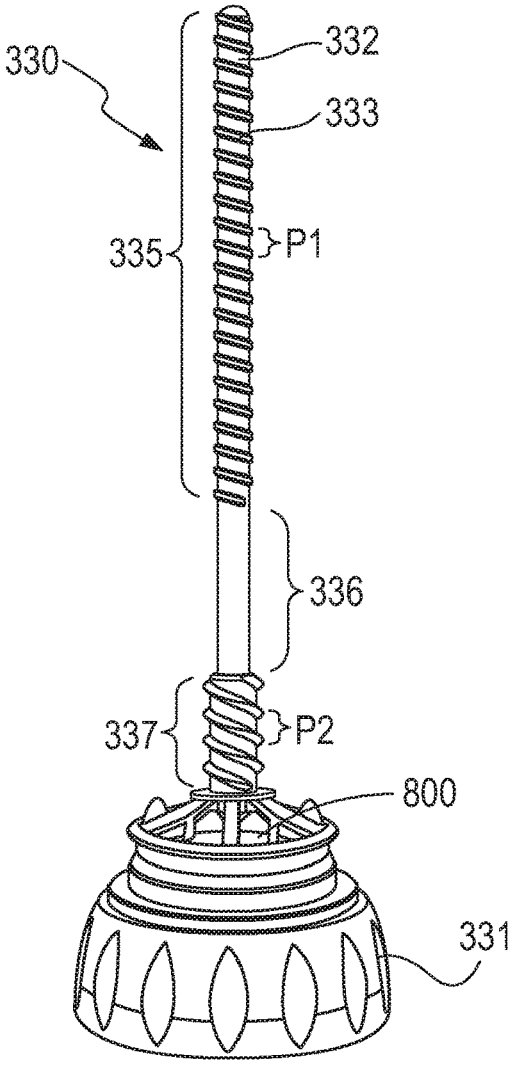
FIG. 25 is a perspective, front view of another screw assembly of a dispensing package according to one or more aspects.
Figure 26:
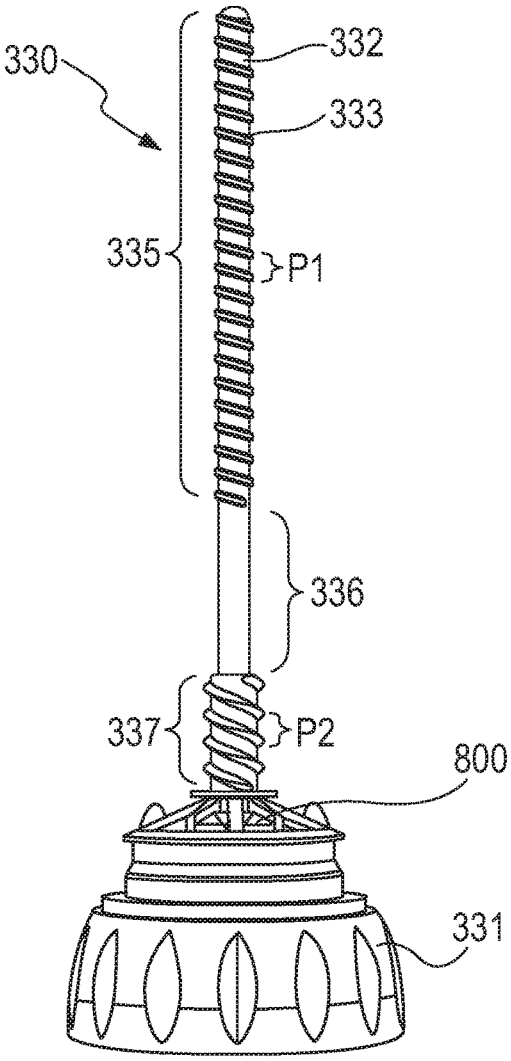
FIG. 26 is a back view of the screw assembly of FIG. 25.
Figure 27:
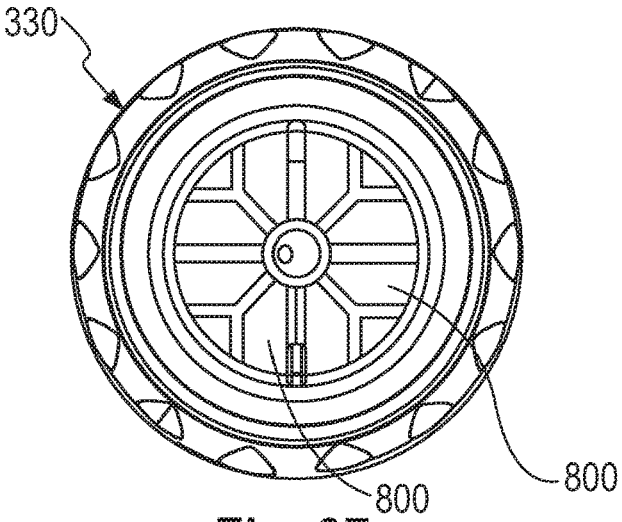
FIG. 27 is a top view of the screw assembly of FIG. 25.
Figure 28:
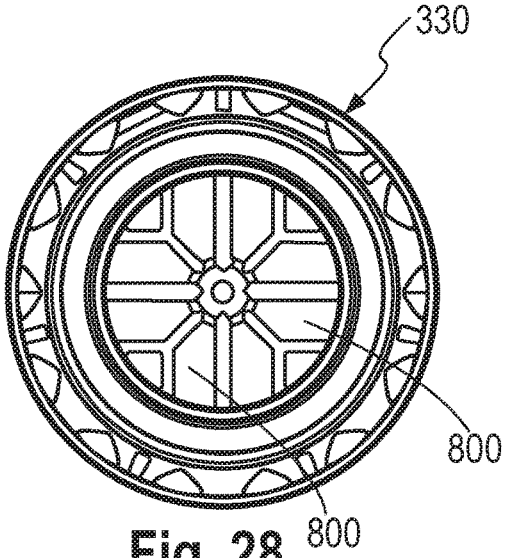
FIG. 28 is a bottom view of the screw assembly of FIG. 25.

As shown in FIGS. 25 and 26, the screw assembly 330 may not include a ratchet platform 380. The screw base 331 of the screw assembly 330 may be engineered to have an internal open configuration that allows for bottom filling. The screw base 331 may include one or more apertures 800 to allow for bottom filling when the screw assembly 330 is to be incorporated into the dispensing package 100 that will be bottom filled. As shown in FIGS. 27 and 28, the screw base 331 may include numerous apertures 800 that should be engineered to provide little or no obstruction so as to have an internal open configuration that allows for bottom filling while also maintaining the structural integrity and stiffness between the screw base 331 and the spindle 332.

Optional Aspects of the Ratchet

Figure 29:
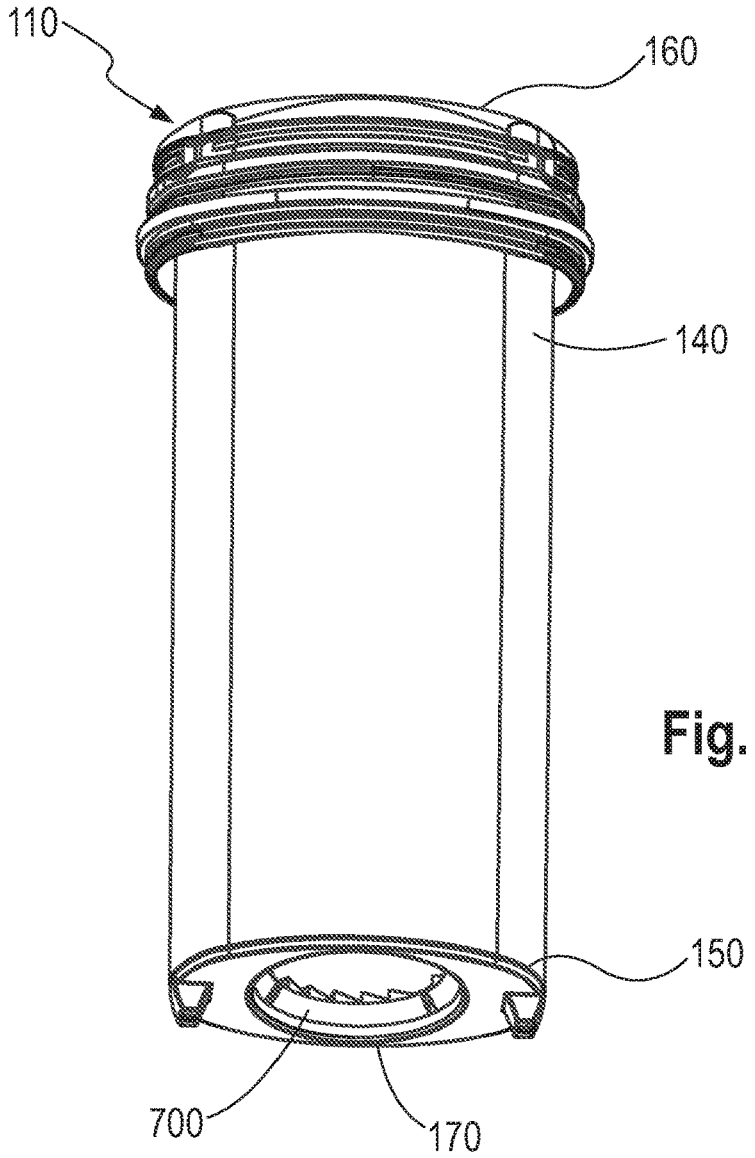
FIG. 29 is a perspective, front view of a jacket, e.g. a product chamber of a dispensing package according to one or more aspects.

The mechanism for axially advancing the movable elevator platform 320 may include the screw assembly 330 and a ratchet 700 non-removably incorporated into the lower end 240 of the outer jacket 200 or at the lower end 150 of the product chamber 110, as shown in FIG. 29. The ratchet 700 at a lower end 240 of the outer jacket 200 or at the lower end 150 of the product chamber 110 may be molded as a single part within the outer jacket 200 or the product chamber 110, as depicted in FIGS. 29 and 30.

Although the outer jacket 200 or the product chamber 110 may include a non-removable ratchet 700, the screw assembly 330 included in the dispensing package 100 may vary depending on the product form and the method of filing. The dispensing package 100 may include a screw assembly 330 that includes at least one pawl 780 or may include a screw assembly 330 that does not include at least one pawl 780, but has a screw base 331 that allows for bottom filling, as depicted in FIGS. 25-28.

Figure 30:
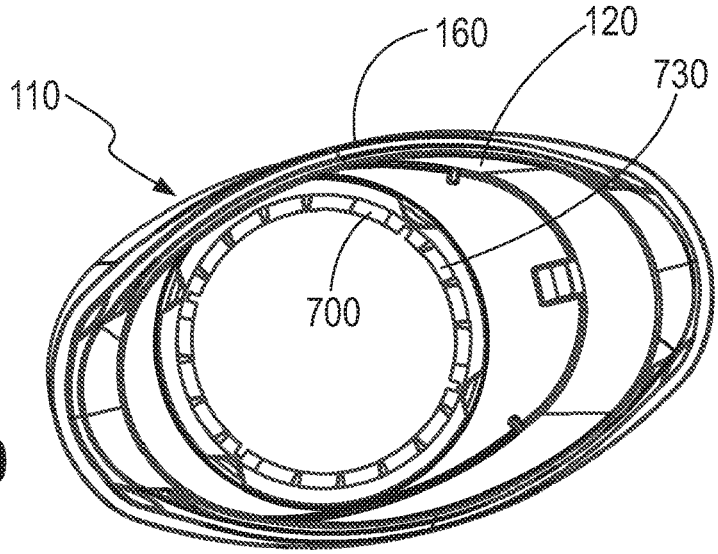
FIG. 30 is an enlarged view of an area within FIG. 29.

As shown in FIGS. 29 and 30, the jacket, e.g. the product chamber 110 may include a ratchet 700 located at the lower end 150 of the product chamber 110 or the jacket. The ratchet 700 may be designed to surround the bottom opening 170. The bottom opening 170 may be large enough to allow for bottom filling. The diameter of the bottom opening 170 may be 22.79 mm (0.90 inch) or greater. The diameter of the bottom opening 170 may range from 10 mm to 50 mm (from 0.39 inch to 1.97 inch).

Figure 31:
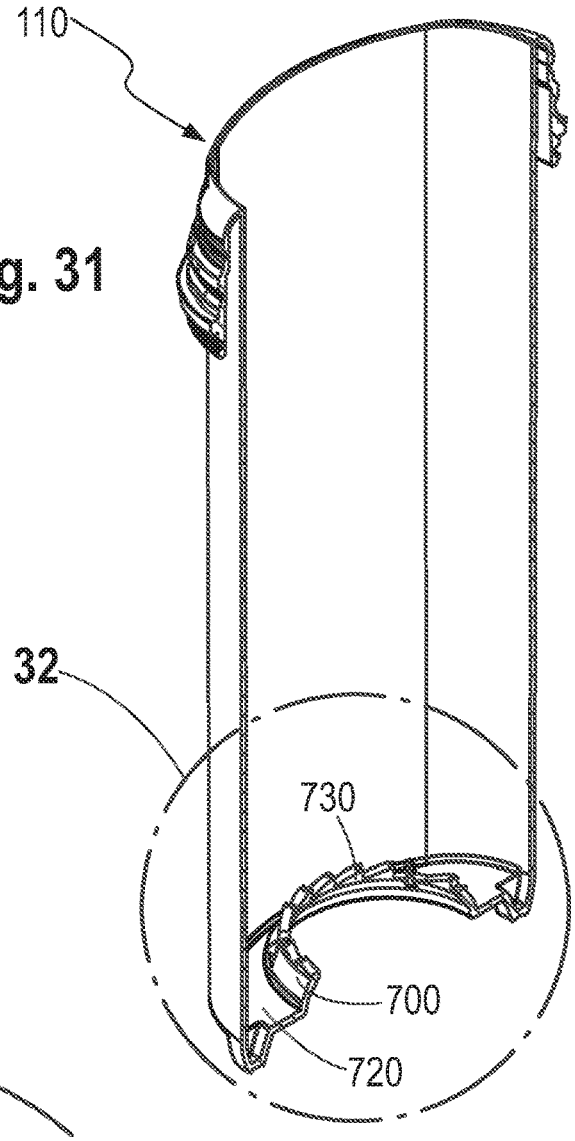
FIG. 31 is a cross-sectional, perspective, side view of the jacket of FIG. 29.
Figure 32:
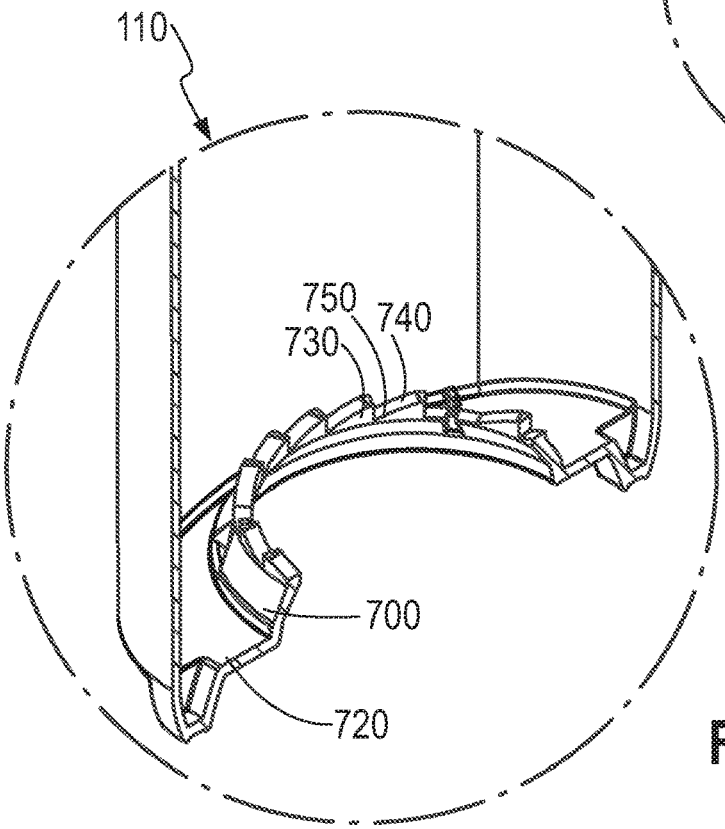
FIG. 32 is an enlarged, cross-sectional, perspective, side view of the jacket of FIG. 31.

As shown in FIGS. 31 and 32, a plurality of the one-way ratchet teeth 730 may be rigidly affixed to the circumference of the ratchet 700. Two-way ratchet teeth 730 may be used. As shown in FIGS. 31 and 32, the ratchet 700 may be raised above the interior floor 720 of the product chamber 110. The ratchet 700 may include from 8 to 32 ratchet teeth 730, although the number of ratchet teeth 730 may be adapted to provide the desired dose/function. The ratchet 700 includes from 12 to 20 ratchet teeth 730. The ratchet teeth 730 may include a face 740. The length of the face 740 may be from 0.5 mm to 5 mm in length (from 0.019 inch to 0.19 inch). The ratchet teeth 730 may have a height, as measured from the base to the highest point, of 0.254 mm to 3 mm (from 0.01 inch to 0.12 inch), preferably from 0.51 mm to 2.0 mm (from 0.02 inch to 0.078 inch). The ratchet teeth 730 may be positioned in close proximity to each other so that the pawl 780 can move to the subsequent ratchet tooth 730 with ease. The ratchet teeth 730 may also have a lead angle 750 which may be from 10 to 80 degrees, preferably from 15 to 50 degrees, more preferably from 18 to 25 degrees. Even more preferably, the lead angle 750 may be 21.5 degrees.

Optional Aspects of the Movable Elevator Platform

The dispensing package 100 comprises a movable elevator platform 320 which is movably engaged with the spindle 332 of the screw assembly 330. As shown in FIGS. 33-38, the movable elevator platform 320 comprises a coupling sleeve 325 having an inner surface 550. The coupling sleeve 325 is coaxial to the longitudinal axis L of the dispensing package 100. The coupling sleeve 325 supports internal threads having a first internal thread portion 530 having a first pitch p1 and a second internal thread portion 540 having a second pitch p2.

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

Figure 33:
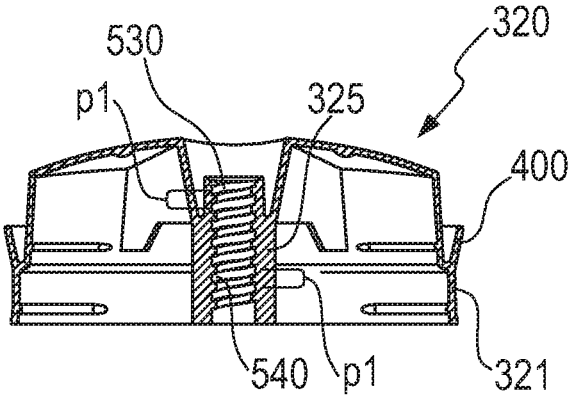
FIG. 33 is a cross sectional view of a movable elevator platform according to one or more aspects.
Figure 34:
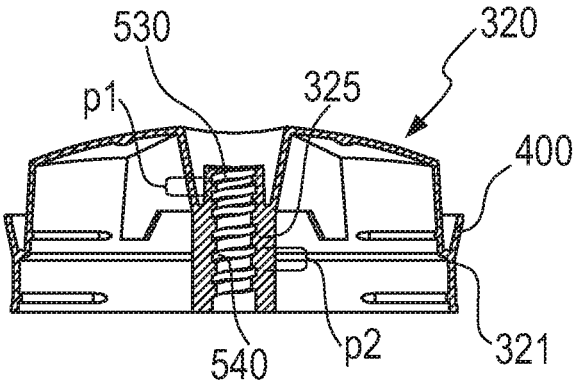
FIG. 34 is a cross sectional view of another movable elevator platform according to one or more aspects.

As shown in FIG. 33, the coupling sleeve 325 supports internal threads having a first internal thread portion 530 and a second internal thread portion 540 having the same first pitch p1. Alternatively, as shown in FIG. 34, the coupling sleeve 325 supports internal threads having a first internal thread portion 530 having a first pitch p1 and a second internal thread portion 540 having a second pitch p2. The second pitch p2 is larger than the first pitch p1.

Figure 35:
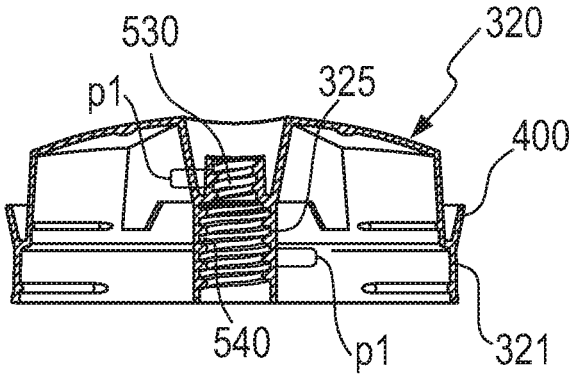
FIG. 35 is a cross sectional view of another movable elevator platform according to one or more aspects.

Alternatively, as shown in FIG. 35, the coupling sleeve 325 supports internal threads having a first internal thread portion 530 having a first major diameter $MD_{10}$ and a first pitch p1 and a second internal thread portion 540 having a second major diameter $MD_{20}$ and the first pitch p1. The second major diameter $MD_{20}$ is larger than the first major diameter $MD_{10}$.

Figure 36:
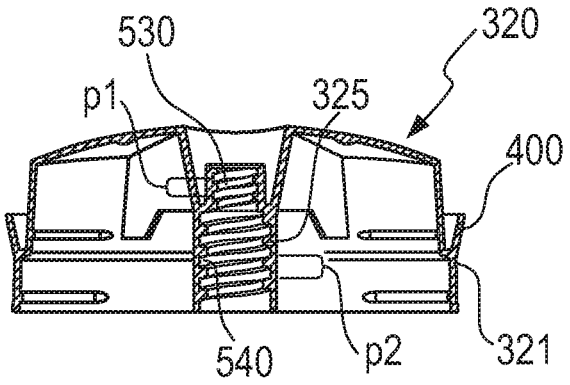
FIG. 36 is a cross sectional view of another movable elevator platform according to one or more aspects.
Figure 37:
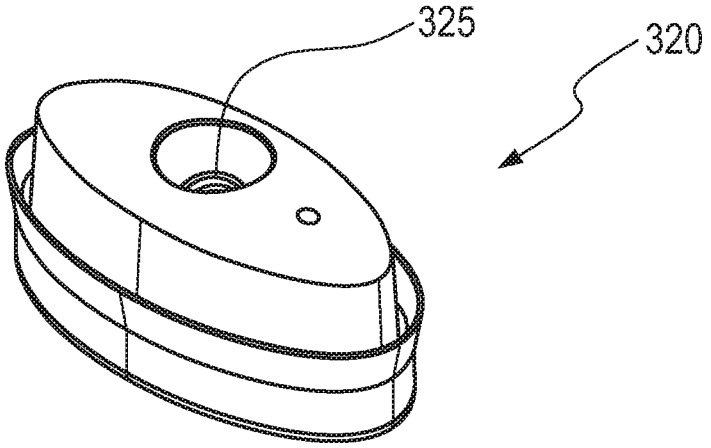
FIG. 37 is a perspective, front view of a movable elevator platform according to one or more aspects.
Figure 38:
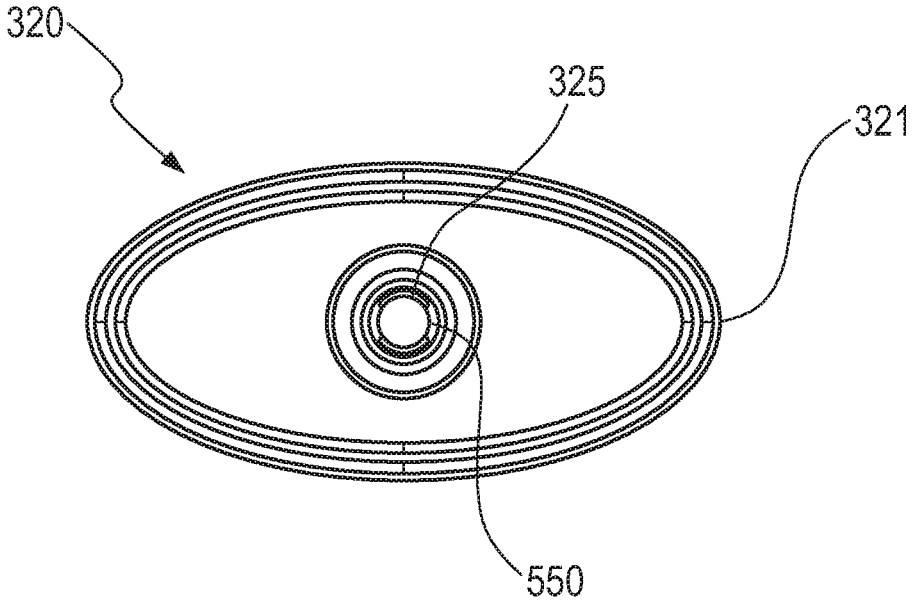
FIG. 38 is a top view of the movable elevator platform of FIG. 37.

Alternatively, as shown in FIG. 36, the coupling sleeve 325 supports internal threads having a first internal thread portion 530 having a first major diameter $MD_{10}$ and a first pitch p1 and a second internal thread portion 540 having a second major diameter $MD_{20}$ and a second pitch p2. The second major diameter $MD_{20}$ is larger than the first major diameter $MD_{10}$. The second pitch p2 is larger than the first pitch p1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A dispensing package comprising:
a longitudinal axis;
one or more jackets, wherein the one or more jackets comprise a first end, a second end opposite the first end;
a screw assembly; and a movable elevator platform;
wherein the screw assembly comprises:
a screw base disposed adjacent to the first end and rotatably associated with the one or more jackets;
a spindle that supports external threads, wherein the spindle extends from the screw base through the first end into the one or more jackets coaxial to the longitudinal axis of the dispensing package;
wherein the spindle comprises:
a first external thread portion having a first pitch; and
a second external thread portion having a second pitch;
wherein the second pitch is larger than the first pitch;
wherein the movable elevator platform is movably engaged with the spindle of the screw assembly and comprises a coupling sleeve having an inner surface, wherein the coupling sleeve is coaxial to the longitudinal axis of the dispensing package, wherein the coupling sleeve supports internal threads that have:
a first internal thread portion having a first pitch;
a second internal thread portion having a second pitch;
wherein the first external thread portion of the screw assembly can engage with the first internal thread portion of the movable elevator platform along the inner surface of the movable elevator platform such that the first pitch of the first internal thread portion and the first pitch of the first external thread portion are the same;
wherein the second external thread portion of the screw assembly can engage with the second internal thread portion of the movable elevator platform along the inner surface of the movable elevator platform such that the second pitch of the second internal thread portion is comprised between the first pitch of the first external thread portion and the second pitch of the second external thread portion.

2. The dispensing package according to claim 1, wherein the second external thread portion of the screw assembly can engage with the second internal thread portion of the movable elevator platform along the inner surface of the movable elevator platform such that the second pitch of the second internal thread portion and the first pitch of the first external thread portion are the same.

3. The dispensing package according to claim 1, wherein the second external thread portion of the screw assembly can engage with the second internal thread portion of the movable elevator platform along the inner surface of the movable elevator platform such that the second pitch of the second internal thread portion and the second pitch of the second external thread portion are the same.

4. The dispensing package according to claim 1,
wherein the first external thread portion has a major diameter;
wherein the second external thread portion has the major diameter;
wherein the first internal thread portion has a major diameter;
wherein the second internal thread portion has the major diameter;
such that the external threads of the first external thread portion of the spindle can engage with the internal threads of the first internal thread portion of the movable elevator platform; and
such that the external threads of the second external thread portion of the spindle can engage with the internal threads of the second internal thread portion of the movable elevator platform.

5. The dispensing package according to claim 4,
wherein the major diameter of the first external thread portion and the second external thread portion of the spindle is smaller than the major diameter of the respective first internal thread portion and the second internal thread portion of the coupling sleeve.

6. The dispensing package according to claim 1,
wherein the first external thread portion has a major diameter;
wherein the second external thread portion has a major diameter;
wherein the major diameter of the second external thread portion is larger than the major diameter of the first external thread portion;
wherein the first internal thread portion has a major diameter;
wherein the second internal thread portion has a major diameter;
wherein the major diameter of the second internal thread portion is larger than the major diameter of the first internal thread portion;
such that the external threads of the first external thread portion of the spindle can engage with the internal threads of the first internal thread portion of the movable elevator platform; and
such that the external threads of the second external thread portion of the spindle can engage with the internal threads of the second internal thread portion of the movable elevator platform.

7. The dispensing package according to claim 6,
wherein the major diameter of the first external thread portion of the spindle is smaller than the major diameter of the first internal thread portion of the coupling sleeve; and
wherein the major diameter of the second external thread portion of the spindle is smaller than the major diameter of the second internal thread portion of the coupling sleeve.

8. The dispensing package according to claim 1, wherein the spindle of the screw assembly comprises a third non-threaded portion located between the first external thread portion and the second external thread portion.

9. The dispensing package according to claim 8, wherein the third non-threaded portion has a height as measured along the longitudinal axis;

wherein the coupling sleeve of the movable elevator platform has a height as measured along the longitudinal axis; and wherein the height of the third non-threaded portion is above the second pitch of the second external thread portion of the spindle and less than the height of the coupling sleeve of the movable elevator platform.

10. The dispensing package according to claim 1, wherein the one or more jackets comprise an outer jacket and a product chamber; wherein the outer jacket comprises a top opening and a bottom opening; wherein the product chamber is disposed within the outer jacket; and wherein the product chamber comprises a top opening and a bottom opening.

11. The dispensing package according to claim 1, wherein the external threads of the spindle and/or the internal threads of the coupling sleeve are helical threads which are continuous and/or interrupted.

12. The dispensing package according to claim 1, wherein the first external thread portion of the screw assembly and the first internal thread portion of the movable elevator platform comprises a first gap from about 0.001 inch (25.4 μm) to about 0.020 inch (0.51 mm).

13. The dispensing package according to claim 1, wherein the second external thread portion of the screw assembly and the second internal thread portion of the movable elevator platform comprises a second gap be from about 0.001 inch (25.4 μm) to about 0.020 inch (0.51 mm).

14. The dispensing package according to claim 1, wherein the first external thread portion of the screw assembly and the first internal thread portion of the movable elevator platform comprises a first interference Nominal from about 0.000 inch (0.00 mm) to about 0.060 inch (1.52 mm).

15. The dispensing package according to claim 1, wherein the second external thread portion of the screw assembly and the second internal thread portion of the movable elevator platform comprises a second interference Nominal from about 0.000 inch (0.00 mm) to about 0.060 inch (1.52 mm).

* * * * *